US010678164B2

(12) United States Patent
Kusano et al.

(10) Patent No.: US 10,678,164 B2
(45) Date of Patent: Jun. 9, 2020

(54) DEVELOPER CONTAINER, DEVELOPING DEVICE AND PROCESS CARTRIDGE

(71) Applicant: CANON KABUSHIKI KAISHA, Tokyo (JP)

(72) Inventors: Yohei Kusano, Numazu (JP); Naoya Asanuma, Susono (JP); Takatoshi Hamada, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/357,412

(22) Filed: Mar. 19, 2019

(65) Prior Publication Data

US 2019/0302651 A1 Oct. 3, 2019

(30) Foreign Application Priority Data

Mar. 30, 2018 (JP) ..... 2018-066569

(51) Int. Cl.
*G03G 15/08* (2006.01)
*G03G 21/18* (2006.01)

(52) U.S. Cl.
CPC ..... *G03G 15/0882* (2013.01); *G03G 15/0889* (2013.01); *G03G 21/1832* (2013.01); *G03G 2215/0687* (2013.01)

(58) Field of Classification Search
CPC ..... G03G 15/0687; G03G 15/0882; G03G 2215/0889; G03G 21/1832
See application file for complete search history.

(56) References Cited

U.S. PATENT DOCUMENTS 4,914,481 A * 4/1990 Yoshikai ..... G03G 15/0822 399/230
5,216,462 A * 6/1993 Nakajima ..... G03G 15/0856 118/694
9,104,137 B2 8/2015 Murata et al.
(Continued)

FOREIGN PATENT DOCUMENTS

JP H08240973 A 9/1996
JP 2000181207 A 6/2000
(Continued)

OTHER PUBLICATIONS

Copending U.S. Appl. No. 16/357,659, filed Mar. 19, 2019.
(Continued)

*Primary Examiner* — David J Bolduc
(74) *Attorney, Agent, or Firm* — Rossi, Kimms & McDowell LLP

(57) ABSTRACT

A developer container includes a developer accommodating portion, a rotatable member, and a flexible sheet member. The developer container further includes an elastically deformable elastic member. With respect to a longitudinal direction of the developer accommodating portion, between an end portion of the rotatable member and an inside surface of the developer accommodating portion, a gap is formed to permit movement of the rotatable member relative to the developer accommodating portion. In an unused state, the sheet member is elastically deformable together with the elastic member by the movement of the rotatable member relative to the developer accommodating portion in the longitudinal direction.

12 Claims, 11 Drawing Sheets

(56) References Cited

U.S. PATENT DOCUMENTS

| | | | | |
|---|---|---|---|---|
| 9,188,906 | B2 | 11/2015 | Batori et al. | |
| 2009/0169241 | A1* | 7/2009 | Mimura | G03G 15/0875 399/106 |
| 2013/0136489 | A1* | 5/2013 | Yamaguchi | G03G 15/0882 399/106 |
| 2013/0164039 | A1* | 6/2013 | Matsushita | G03G 21/18 399/258 |
| 2013/0308971 | A1* | 11/2013 | Kashiide | G03G 15/0882 399/106 |
| 2013/0308972 | A1* | 11/2013 | Shindo | G03G 15/0882 399/106 |
| 2013/0308979 | A1* | 11/2013 | Matsuzaki | G03G 15/0874 399/111 |
| 2013/0343785 | A1* | 12/2013 | Matsuzaki | G03G 15/0874 399/258 |
| 2014/0064793 | A1* | 3/2014 | Matsuzaki | G03G 21/1676 399/258 |
| 2014/0072330 | A1* | 3/2014 | Yoshida | G03G 15/0884 399/106 |
| 2014/0072345 | A1* | 3/2014 | Matsunaga | G03G 15/0874 399/262 |
| 2014/0072347 | A1* | 3/2014 | Furutani | G03G 15/0874 399/262 |
| 2014/0079432 | A1* | 3/2014 | Matsuzaki | G03G 15/0874 399/106 |
| 2014/0086620 | A1* | 3/2014 | Takeuchi | G03G 15/0882 399/106 |
| 2014/0086621 | A1* | 3/2014 | Makiguchi | G03G 15/0877 399/106 |
| 2014/0199092 | A1* | 7/2014 | Matsushita | G03G 15/0898 399/106 |
| 2015/0117904 | A1* | 4/2015 | Mori | G03G 15/0891 399/254 |
| 2016/0062270 | A1* | 3/2016 | Fukasawa | G03G 15/0889 399/106 |
| 2016/0282763 | A1* | 9/2016 | Maeshima | G03G 15/0882 |
| 2016/0282764 | A1* | 9/2016 | Gofuku | G03G 15/0882 |
| 2016/0349669 | A1* | 12/2016 | Oshima | G03G 21/1814 |
| 2017/0261886 | A1* | 9/2017 | Isobe | G03G 15/0881 |
| 2017/0285527 | A1* | 10/2017 | Okabe | G03G 15/0886 |
| 2018/0011426 | A1* | 1/2018 | Mizutani | G03G 15/0898 |
| 2018/0164714 | A1* | 6/2018 | Takahashi | G03G 15/0893 |
| 2019/0113865 | A1* | 4/2019 | Matsuzaki | G03G 15/0874 |

FOREIGN PATENT DOCUMENTS

| | | | |
|---|---|---|---|
| JP | 2004205758 | A | 7/2004 |
| JP | 2013076755 | A | 4/2013 |
| JP | 2014112206 | A | 6/2014 |
| JP | 2014149412 | A | 8/2014 |
| JP | 2015087664 | A | 5/2015 |

OTHER PUBLICATIONS

Office Action issued in U.S. Appl. No. 16/357,659 dated Sep. 26, 2019.

Office Action issued in U.S. Appl. No. 16/357,659 dated Apr. 28, 2020.

* cited by examiner

DEVELOPER CONTAINER, DEVELOPING DEVICE AND PROCESS CARTRIDGE

FIELD OF THE INVENTION AND RELATED ART

The present invention relates to a developer container provided in an image forming apparatus such as a copying machine or a printer and relates to a developing device and a process cartridge which includes the developer container.

In an image forming apparatus using an electrophotographic image forming type (electrophotographic process), a photosensitive member as an image bearing member (hereinafter, referred to as a photosensitive drum) is electrically charged uniformly. Then, the charged photosensitive drum is selectively exposed to light, so that an electrostatic latent image is formed on a surface of the photosensitive drum. Then, the electrostatic latent image on the photosensitive drum is visualized as a toner image with toner as a developer. Then, the toner image formed on the surface of the photosensitive drum is transferred onto a recording material such as a recording sheet or a plastic sheet, and further, the toner image transferred on the recording material is fixed on the recording material under application of heat and pressure, so that image recording is carried out.

In such an image forming apparatus, in general, maintenance of various process means is needed. In order to facilitate the maintenance of the various process means, a process cartridge which is prepared by integrally assembling the photosensitive drum as described above, a charging means, a developing means, a cleaning means and the like into a cartridge (unit) in a frame and which is made mountable in (attachable to) and dismountable (detachable) from an image forming apparatus main assembly has been put into practical use. According to a process cartridge type, it is possible to provide an image forming apparatus excellent in usability (ease of use).

The developing device generally includes a developer carrying member as developing means for supplying a developer to the photosensitive drum, a developing portion in which a developer supplying member for supplying the developer to the developer carrying member, and a developer container for accommodating the developer to be supplied to the developing portion. Here, feeding of the developer from the developer container toward the developing portion is performed using a rotatable stirring member in general.

In such a constitution, the developer localizes and agglomerates in the developer container during transportation or the like in some instances. In a state in which the developer agglomerates, there is a liability that a rotational load of a stirring member extremely increases. Therefore, in Japanese Laid-Open Patent Application (JP-A) Hei 8-240973, separately from the stirring member, a swingable plate is provided on an inner wall of a toner container by interposing a spring therebetween, and the developer in the toner container is swung by swinging the swingable plate by vibration during the transportation or the like, so that agglomeration of the developer is suppressed.

Further, in JP-A 2000-181207, when a driving force is transmitted from a driving member to a stirring member, not only the stirring member is made movable in one direction on a side where the stirring member is spaced from the driving member with respect to a rotational axis direction but also the stirring member is urged by an urging member in a direction in which the stirring member approaches the driving member. In this constitution, when the stirring member is driven in a state in which a rotational load is large, the stirring member swings with respect to a rotational axis direction without rotating and loosens the agglomerated developer, so that when the developer is loosened and the rotational load is decreased, the stirring member rotates.

However, in JP-A Hei 8-240973 and JP-A 2000-181207, a constitution in which the agglomeration of the developer generating during the transportation can be effectively suppressed by a simple structure without adding a swingable separate member has not yet been sufficiently studied.

SUMMARY OF THE INVENTION

The present invention has solved the above-described problem. A principal object of the present invention is to provide a developer container capable of effectively suppressing agglomeration of a developer generating during transportation.

Another object of the present invention is to provide a developing device and a process cartridge which include the developer container.

According to an aspect of the present invention, there is provided a developer container comprising: a developer accommodating portion configured to accommodate a developer; a rotatable member rotatably supported inside the developer accommodating portion and including a rotation shaft provided along a longitudinal direction of the developer accommodating portion; and a flexible sheet member including a first end portion fixed to the rotatable member and a second end portion which is attached to a part of the developer accommodating portion in an unused state and which is peelable, for use, off the part, wherein the developer container further comprises an elastic member which is provided between an end portion of the rotatable member and an inside surface of the developer accommodating portion with respect to the longitudinal direction and which is elastically deformable in the longitudinal direction, wherein with respect to the longitudinal direction, between the end portion of the rotatable member and the inside surface of the developer accommodating portion, a gap is formed to permit movement of the rotatable member relative to the developer accommodating portion, and wherein in the unused state, the sheet member is elastically deformable together with the elastic member by the movement of the rotatable member relative to the developer accommodating portion in the longitudinal direction.

Further features of the present invention will become apparent from the following description of exemplary embodiments with reference to the attached drawings.

Figure 6:
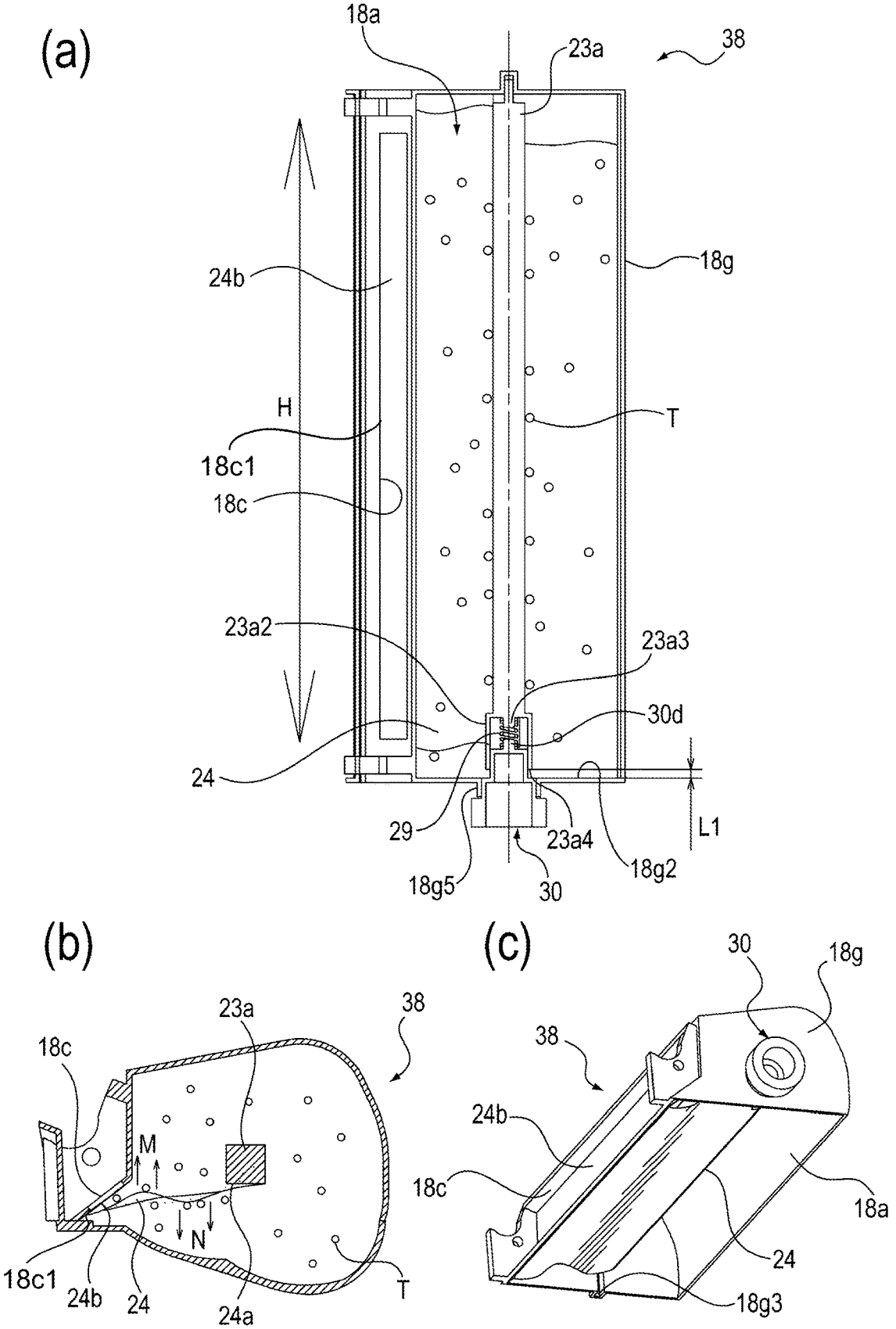

Part (a) of FIG. 6 is a sectional view showing a state in which the developer container in First Embodiment is transported with a drive transmitting member facing downward. Part (b) of FIG. 6 is a sectional view for illustrating behavior of a sealing sheet in the case where the developer container in First Embodiment is transported with the drive transmitting member facing downward. Part (c) of FIG. 6 is a partially perspective view of the sealing sheet as seen from a lower side of part (b) of FIG. 6.

Figure 7:
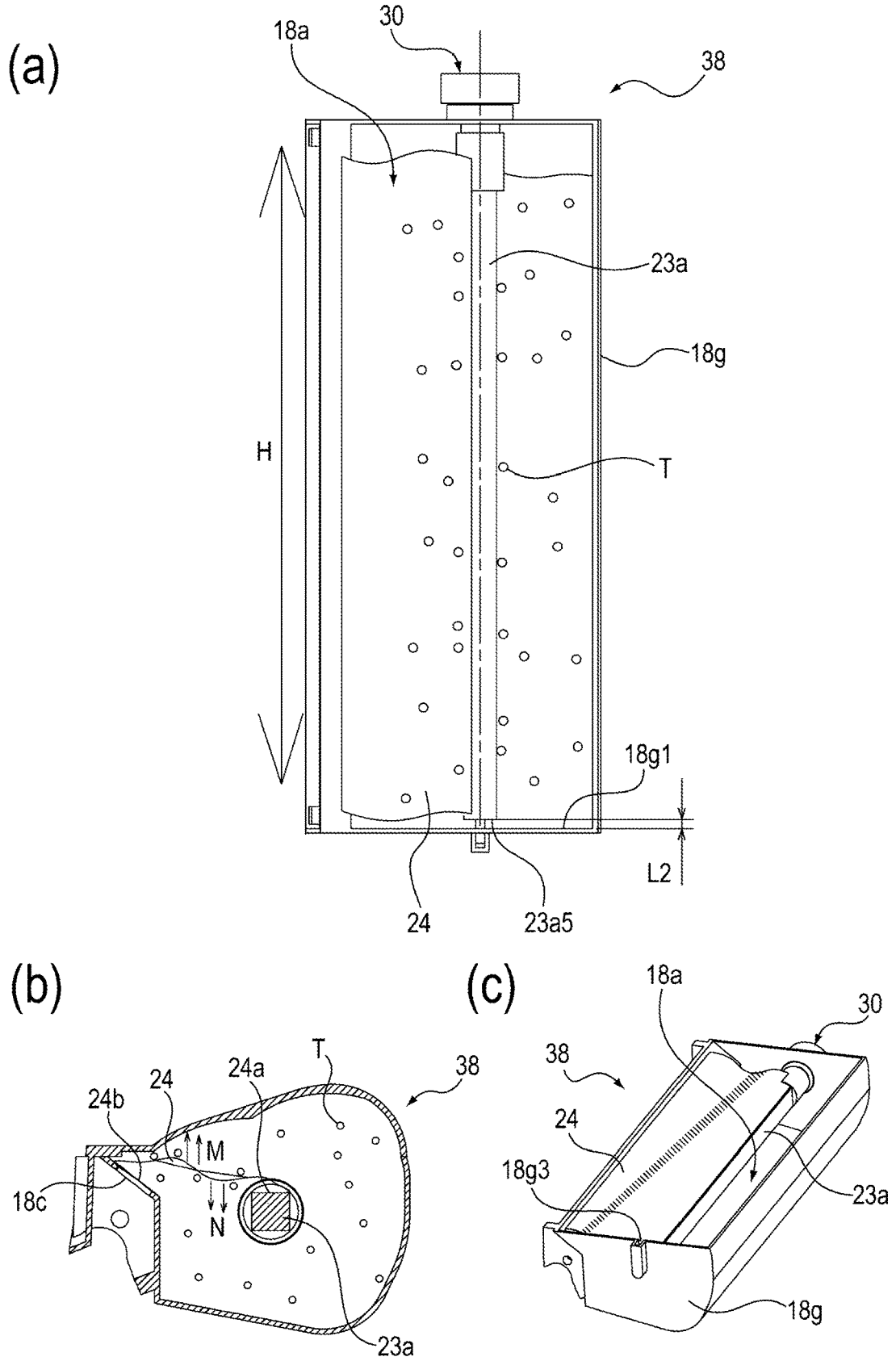

Part (a) of FIG. 7 is a sectional view showing a state in which the developer container in First Embodiment is transported with a drive transmitting member facing upward. Part (b) of FIG. 7 is a sectional view for illustrating behavior of a sealing sheet in the case where the developer container in First Embodiment is transported with the drive transmitting member facing upward. Part (c) of FIG. 7 is a partially perspective view of the sealing sheet as seen from an upper side of part (b) of FIG. 7.

Figure 8:
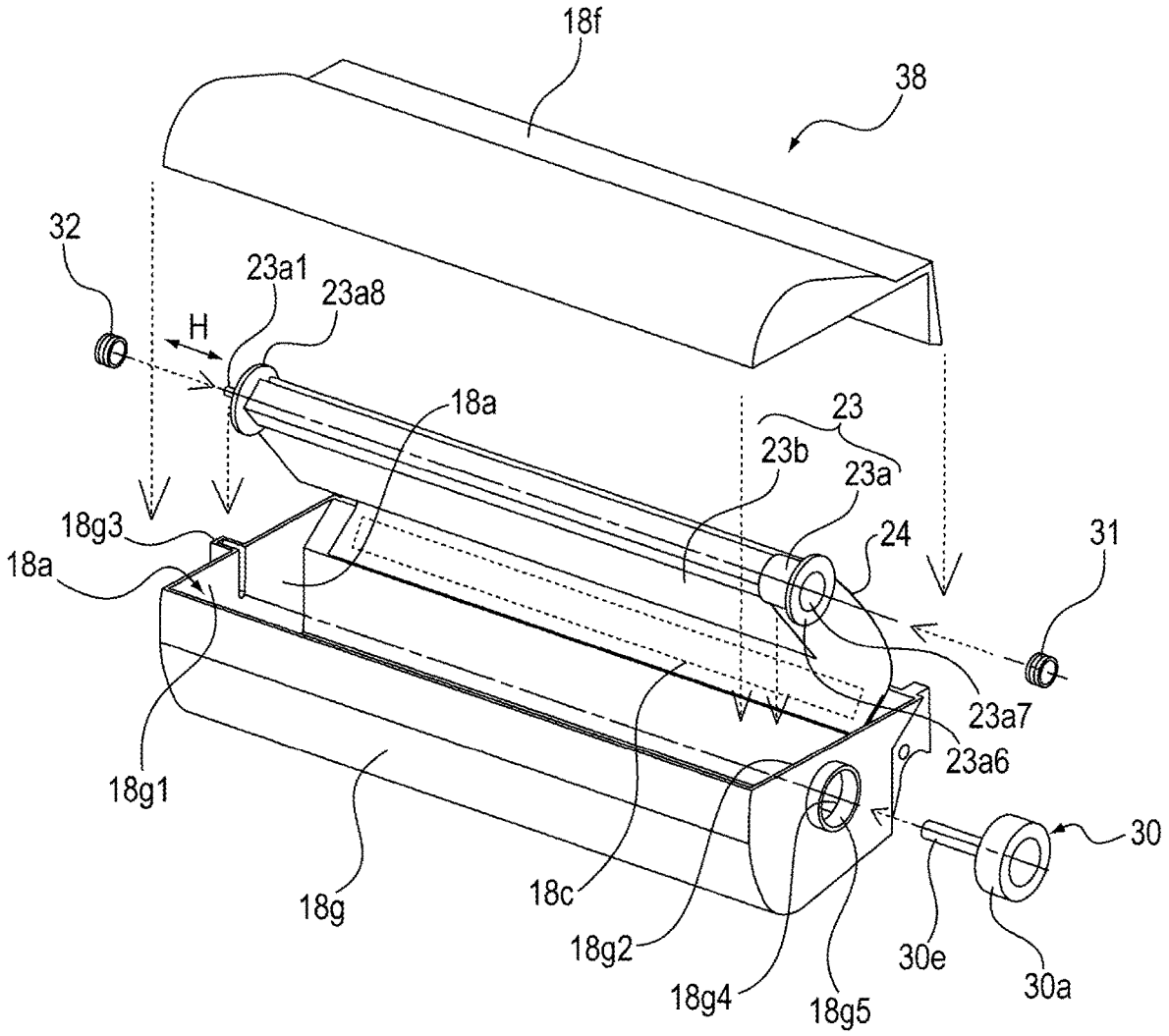

FIG. 8 is an exploded perspective view showing a structure of a developer container in First Embodiment.

Figure 9:
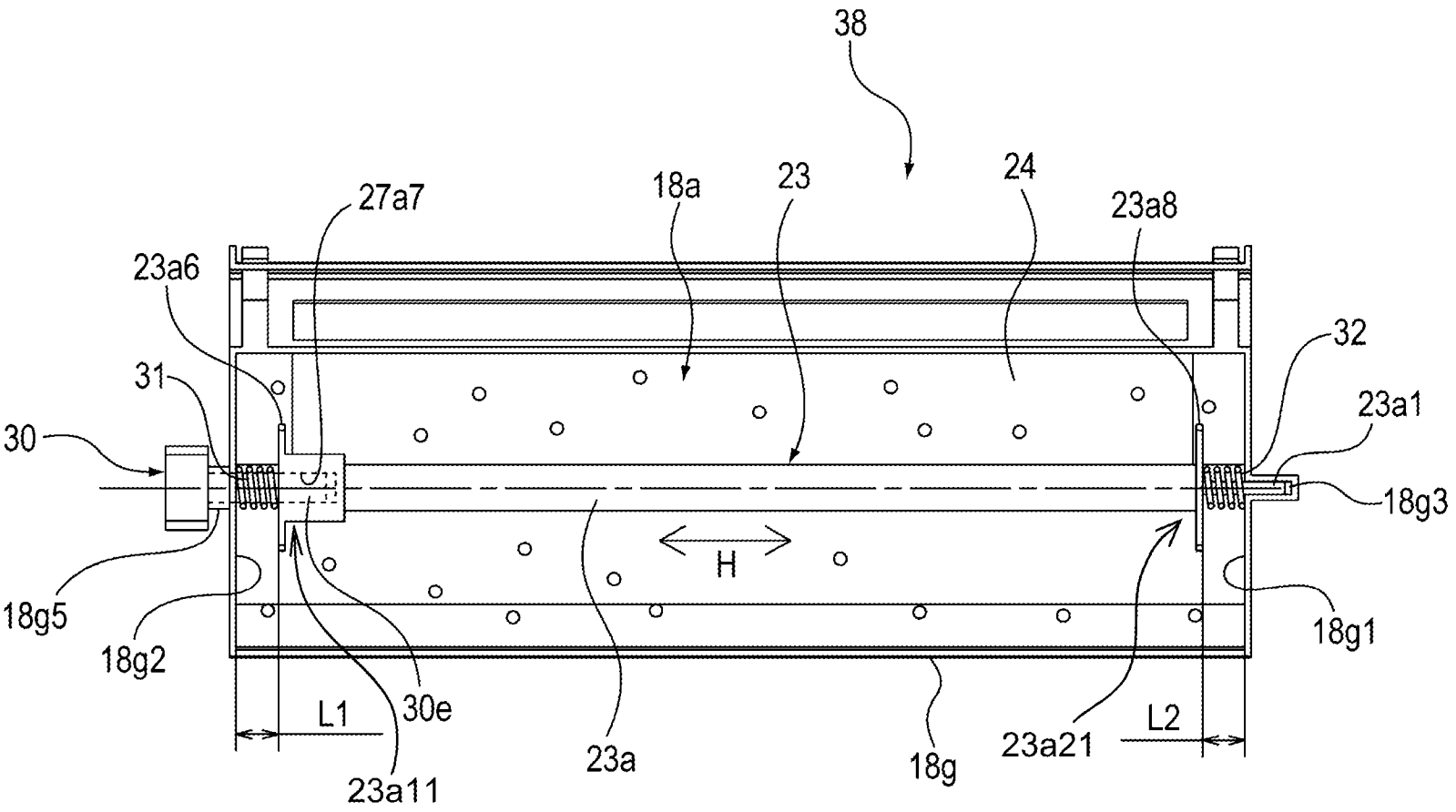

FIG. 9 is a sectional view showing a structure of the developer container in First Embodiment.

Figure 10:
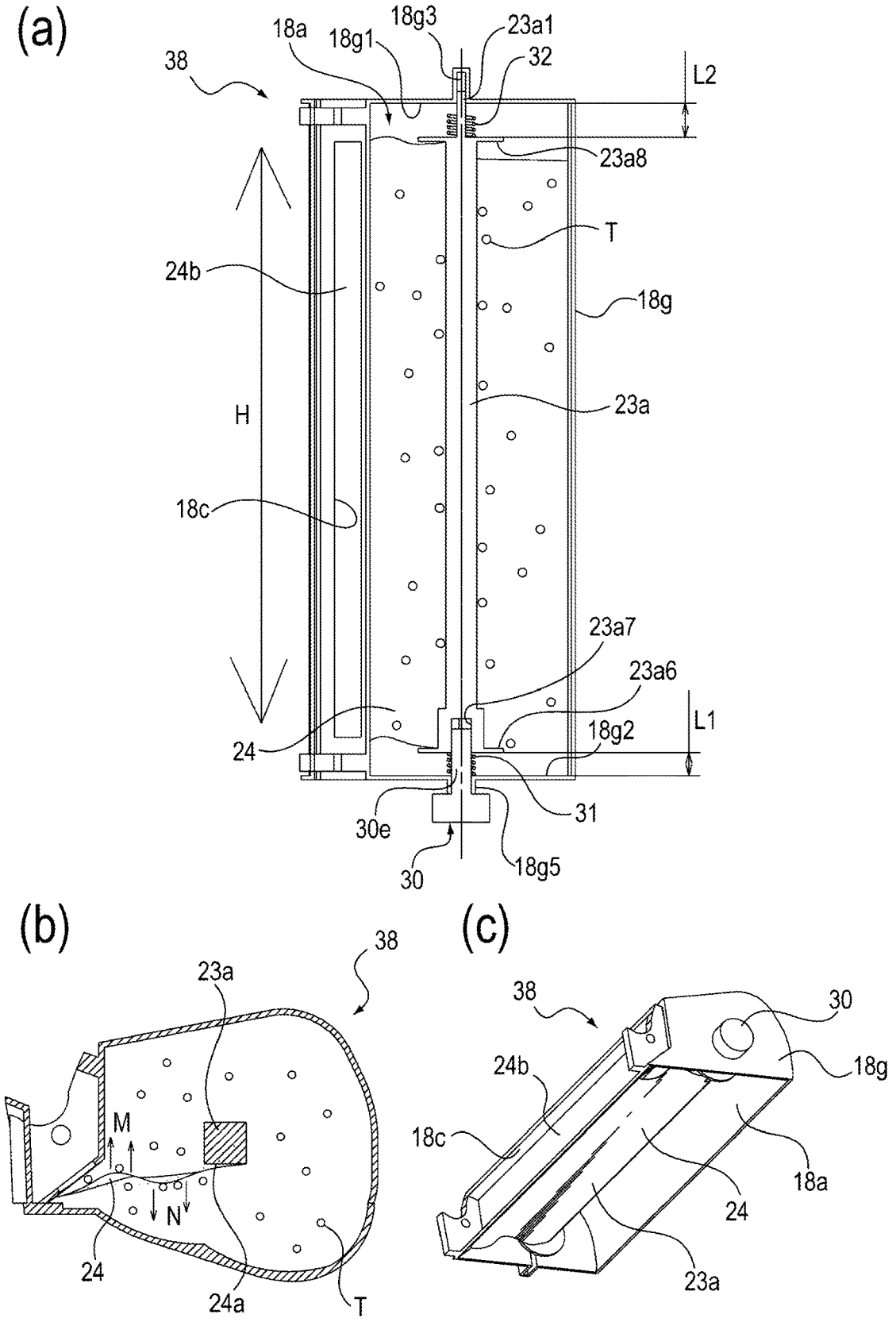

Part (a) of FIG. 10 is a sectional view showing a state in which the developer container in Second Embodiment is transported with a drive transmitting member facing downward. Part (b) of FIG. 10 is a sectional view for illustrating behavior of a sealing sheet in the case where the developer container in Second Embodiment is transported with the drive transmitting member facing downward. Part (c) of FIG. 10 is a partially perspective view of the sealing sheet as seen from a lower side of part (b) of FIG. 10.

Figure 11:
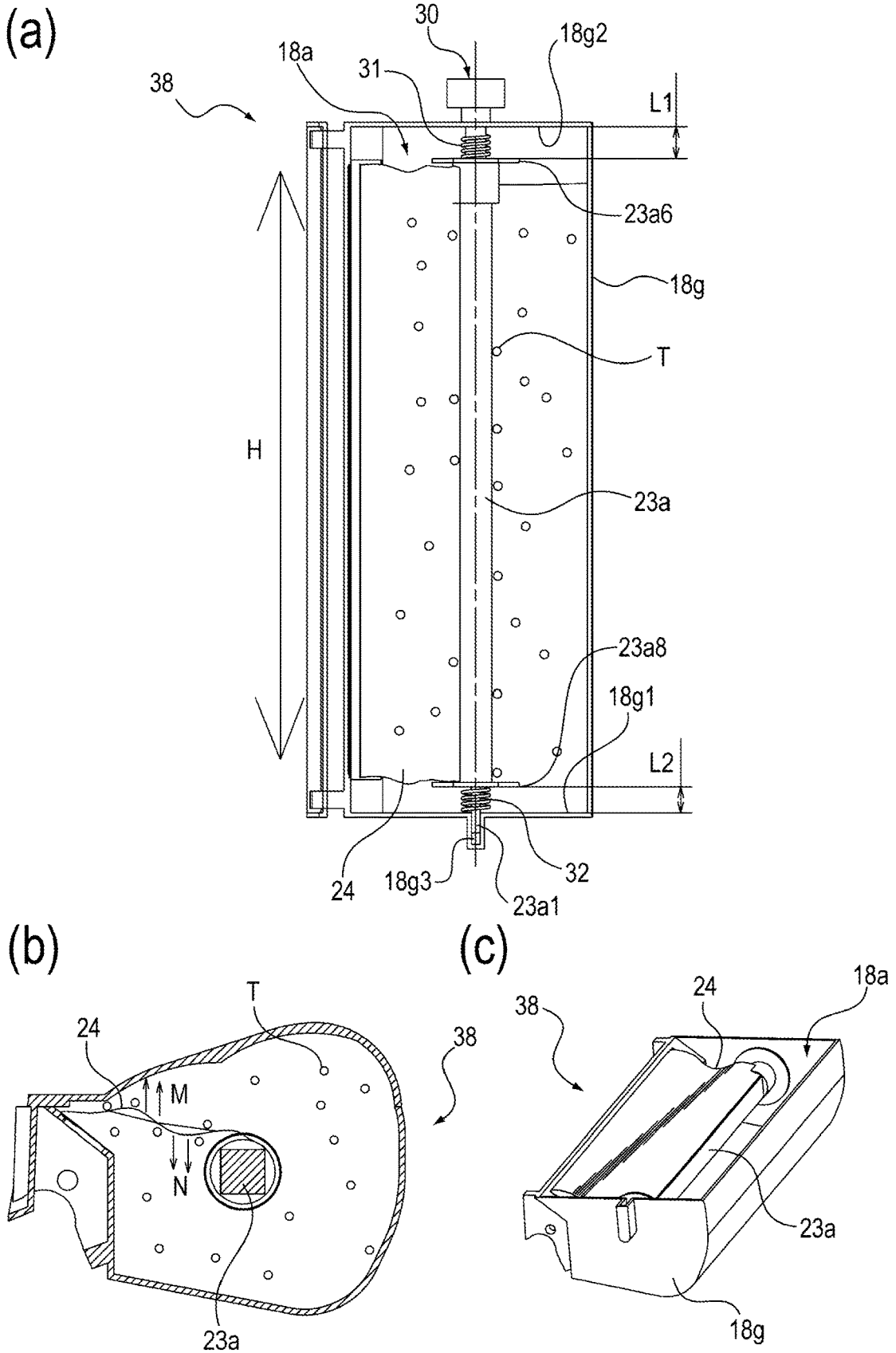

Part (a) of FIG. 11 is a sectional view showing a state in which the developer container in Second Embodiment is transported with a drive transmitting member facing upward. Part (b) of FIG. 11 is a sectional view for illustrating behavior of a sealing sheet in the case where the developer container in Second Embodiment is transported with the drive transmitting member facing upward. Part (c) of FIG. 11 is a partially perspective view of the sealing sheet as seen from an upper side of part (b) of FIG. 11.

DESCRIPTION OF EMBODIMENTS

Embodiments of a developer container according to the present invention, a developing device and a process cartridge will be specifically described with reference to the drawings.

First Embodiment

Using FIGS. 1 to 7, structures of a developer container 38 according to the present invention, a developing device and a process cartridge 7 in this embodiment will be described.

<Image Forming Apparatus>

Figure 1:
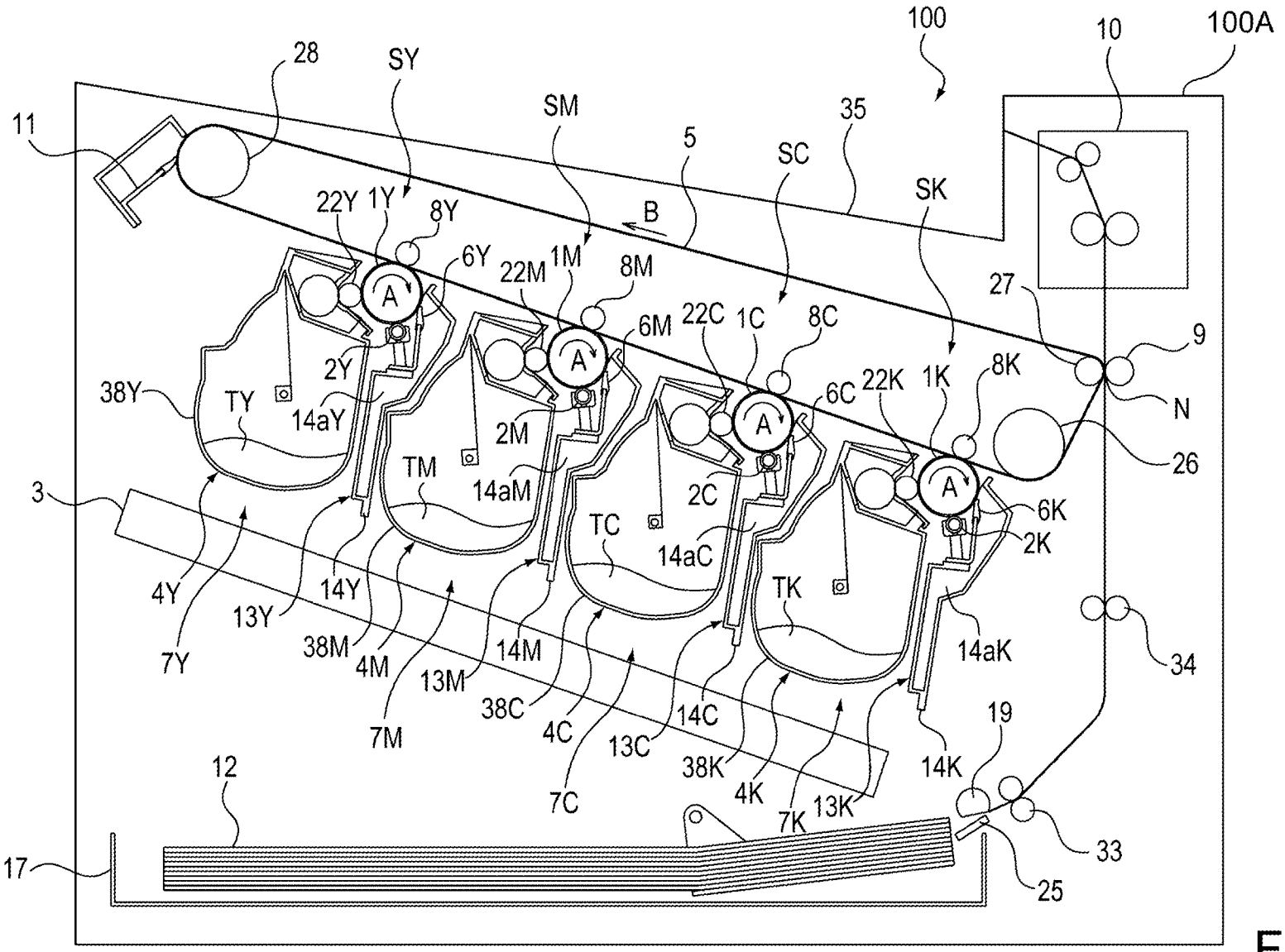
FIG. 1 is a sectional view showing a structure of an image forming apparatus including a developer container according to the present invention.
Figure 2:
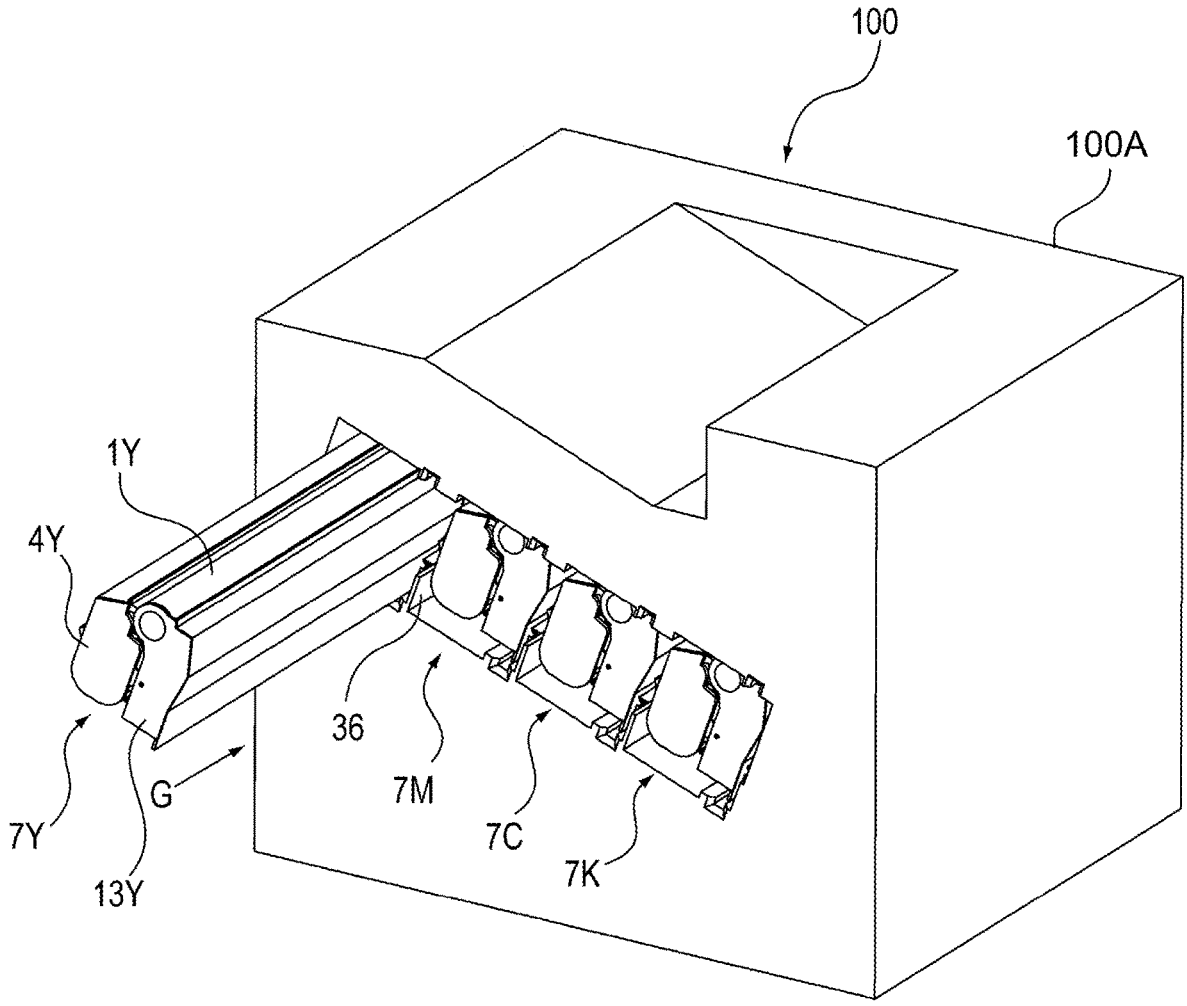
FIG. 2 is a perspective view showing a state in which a process cartridge including the developer container according to the present invention is being mounted into (attachable to) the image forming apparatus.
Figure 3:
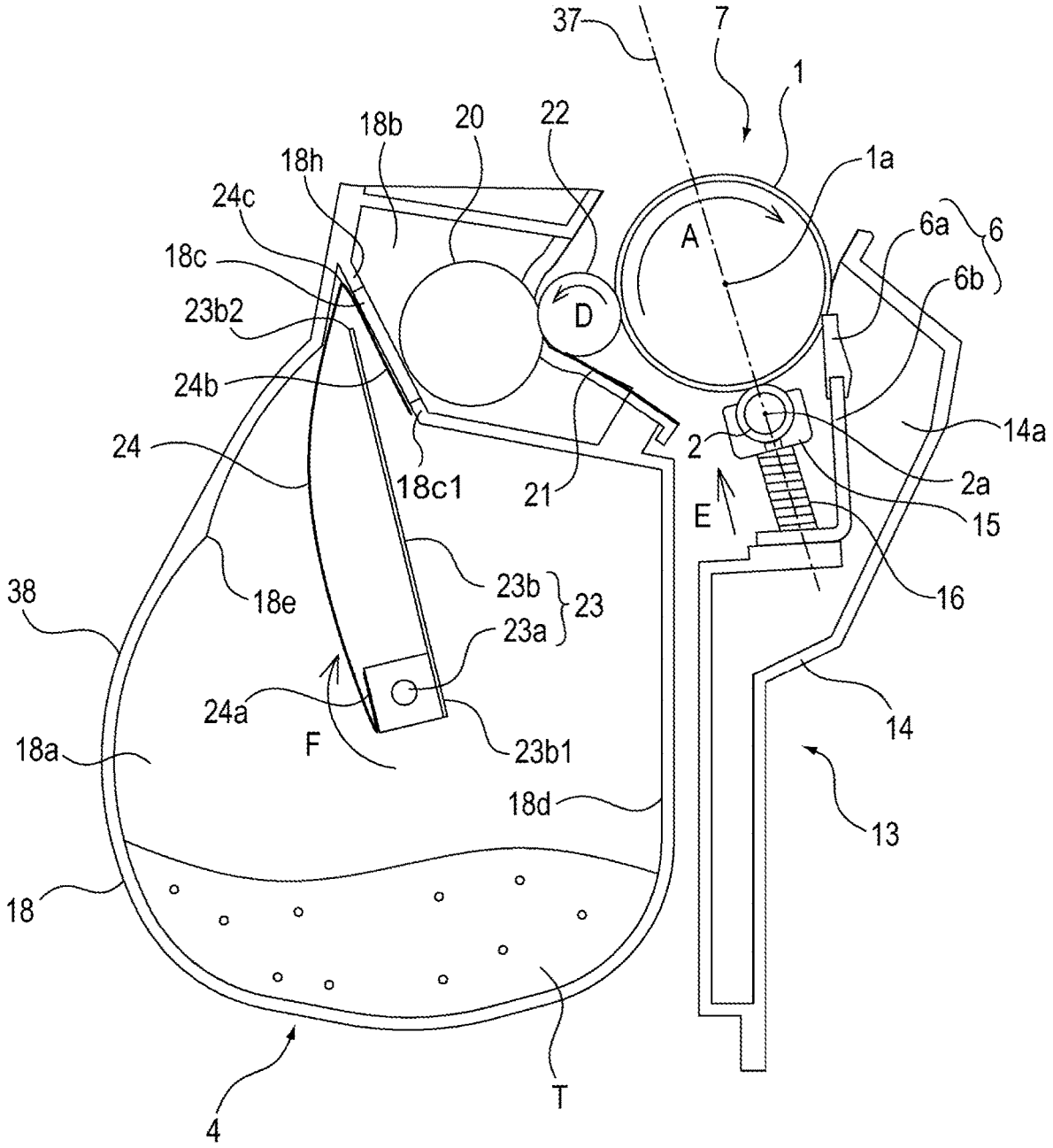
FIG. 3 is a sectional view showing a structure of the process cartridge including the developer container according to the present invention.

Using FIGS. 1 to 3, a structure of an image forming apparatus 100 including the developer container 38 according to the present invention will be described. FIG. 1 is a sectional view showing the structure of the image forming apparatus 100 including the developer container 38. FIG. 2 is a perspective view showing a state in which the process cartridge 7 including the developer container 38 is being mounted into (attached to) the image forming apparatus 100. FIG. 3 is a sectional view showing a structure of the process cartridge 7 including the developer container 38.

The image forming apparatus 100 shown in FIGS. 1 and 2 is an example of an electrophotographic printer. The image forming apparatus 100 shown in FIG. 1 includes, as a plurality of image forming portions, image forming portions SY, SM, SC and SK for forming images of colors of yellow Y, magenta M, cyan C and black K, respectively. Structures and operations of the respective image forming portions SY, SM, SC and SK are substantially the same except that the colors of the images formed are different from each other, and therefore, in the following, these image forming portions is described by simply using the image forming portion S in some cases. This is also true for other image forming process means.

The image forming apparatus 100 shown in FIG. 1 includes four photosensitive drums 1Y, 1M, 1C and 1K as image bearing members for bearing developer images. Each of the photosensitive drums 1 rotates in an arrow A direction in FIG. 1. Around each of the photosensitive drums 1, a charging roller 2 which is a charging means and a scanner unit 3 which is an exposure means are provided. The charging roller 2 is the charging means for electrically charging a surface of the photosensitive drum 1 uniformly. The scanner unit 3 irradiates the uniformly charged surface of the photosensitive drum 1 with laser light on the basis of image information. As a result, an electrostatic latent image is formed on the surface of the photosensitive drum 1.

Around the photosensitive drums 1Y, 1M, 1C and 1K, developing units (developing devices) 4Y, 4M, 4C and 4K are provided, respectively. From each of the developing units 4, toner T (developer) of an associated color is supplied to the electrostatic latent image formed on the surface of the associated photosensitive drum 1. As a result, the toner image is formed on the surface of the photosensitive drum 1. Around the photosensitive drums 1Y, 1M, 1C and 1K, cleaning blades 6Y, 6M, 6C and 6K as cleaning means are further provided, respectively.

An intermediary transfer belt 5 as an intermediary transfer member is provided opposed to the respective photosensitive drums 1. The intermediary transfer belt 5 is stretched rotatably in an arrow B direction in FIG. 1 by a driving roller 26, a secondary transfer opposite roller 27 and a follower roller 28 which are plurality of supporting members. An outer peripheral surface of the intermediary transfer belt 5 contacts the surfaces of all the photosensitive drums 1.

On an inter peripheral surface side of the intermediary transfer belt 5, four primary transfer rollers 8Y, 8M, 8C and 8K are provided opposed to the photosensitive drums 1Y, 1M, 1C and 1K, respectively. A primary transfer bias is applied from an unshown primary transfer bias voltage source to each of the primary transfer rollers 8, so that the toner images formed on the surfaces of the photosensitive drums 1 are successively primary-transferred and superposed onto the outer peripheral surface of the intermediary transfer belt 5. The toner T remaining on the surface of each of the photosensitive drums 1 after primary transfer is scraped off by the associated cleaning blade 6 and is collected in an associated residual toner container 14*a* provided in an associated cleaning (device) frame 14. A secondary transfer roller 9 as a secondary transfer means is provided at a position opposing the secondary transfer opposite roller 27 on the outer peripheral surface side of the intermediary transfer belt 5.

On the other hand, a recording material 12 accommodated in a (sheet) feeding cassette 17 provided at a lower portion of the image forming apparatus 100 is picked up by a pick-up roller 19 and then is separated and fed one by one in cooperation with a separation pod 25. Thereafter, the recording material P is nipped and fed by a feeding roller pair 33, and a leading end of the recording material 12 is abutted against a nip of a registration roller pair 34, which is at rest, by the feeding roller pair 33, so that oblique movement of the recording material 12 is corrected.

In synchronism with timing when a leading end of the toner image formed on the outer peripheral surface of the intermediary transfer belt 5 reaches a secondary transfer portion N which is a nip between the outer peripheral surface of the intermediary transfer belt 5 and the secondary transfer roller 9, the recording material 12 is nipped and fed by the registration roller pair 34. At this time, a secondary transfer bias is applied from a secondary transfer bias voltage source to the secondary transfer roller 9, whereby at the secondary transfer portion N, the toner images primary-transferred superposedly on the outer peripheral surface of the intermediary transfer belt 5 is secondary-transferred onto the recording material 12. The toner T remaining on the outer peripheral surface of the intermediary transfer belt 5 after the secondary transfer is scraped off and collected by a cleaner 11 as a cleaning means.

The recording material 12 on which the toner images are secondary-transferred at the secondary transfer portion N is fed to a fixing device 10 which is a fixing means, and is heated and pressed during nipping and feeding by a heating roller and a pressing roller which are provided in the fixing device 10, so that the toner image is fixed on the recording material 12. Thereafter, the recording material P is discharged onto a discharge tray 35.

The developing units 4Y, 4M, 4C and 4K in this embodiment use toners TY, TM, TC and TK, respectively, each constituting a non-magnetic monocomponent developer as a developer. Each of the developing unit 4 includes a developing roller 22 as a developer carrying member for carrying the toner T (developer). On each developing roller 22, the toner T of an associated color is carried. The developing roller 22 is contacted to the surface of the is photosensitive drum 1, and the toner T of the associated color carried on the surface of the developing roller 22 is supplied to the electrostatic latent image formed on the surface of the photosensitive drum 1, so that contact development is carried out.

In this embodiment, a photosensitive member unit 13 is formed by the photosensitive drum 1, the charging roller 2, the cleaning blade 6 and the cleaning frame 14 including the residual toner accommodating portion 14*a*. Further, the process cartridge 7 is formed by integrally assembling the developing unit 4 and the photosensitive member unit 13 into a cartridge.

Each of the process cartridges 7 is constituted so as to be mountable in (attachable to) and dismountable from (detachable from) the image forming apparatus 100. As shown in FIG. 2, each process cartridge 7 is mounted inside an apparatus main assembly 100A of the image forming apparatus 100 along a mounting guide 36 provided in the image forming apparatus 100, and is positioned at an image forming position shown in FIGS. 1 and 2 by an unshown positioning member.

Each process cartridge 7 is mountable in and dismountable from the image forming apparatus 100 along an axial direction of the photosensitive drum 1 shown as an arrow G direction in FIG. 2. The respective process cartridges 7 are constituted by having the same shape. In the process cartridges 7Y, 7M, 7C and 7K, the toners TY, TM, TC and TK of the colors of yellow Y, magenta M, cyan C and black K are accommodated, respectively.

In this embodiment, the developing unit (developing device) 4 including the developer container 38 and the developing roller (developer carrying member) 22 and the photosensitive member unit 13 including the photosensitive drum (image bearing member) 1 were integrally assembled into a unit. Such a process cartridge 7 was constituted so as to be mountable in and dismountable from the main assembly of the image forming apparatus 100. As another example, the developer container 38 or the developing unit (developing device) 4 may also be assembled into a cartridge and may also be constituted so as to be mountable in and dismountable from the main assembly of the image forming apparatus 100.

<Image Forming Operation>

During image formation, first, the surface of each photosensitive drum 1 rotating in the arrow A direction in FIG. 1 is electrically charged uniformly by the charging roller 2. Then, the laser light is emitted from the scanner unit 3 depending on image information of the associated color. The uniformly charged surface of the photosensitive drum 1 is subjected to scanning exposure to the laser light emitted from the scanner unit 3. As a result, the electrostatic latent image depending on the image information is formed on the surface of the photosensitive drum 1.

Then, the electrostatic latent image formed on the surface of the photosensitive drum 1 is supplied with the toner T of the color by the developing roller 22 provided in the developing unit 4, so that the electrostatic latent image is developed as the toner image. The toner image formed on the surface of the photosensitive drum 1 is primary-transferred onto the outer peripheral surface of the intermediary transfer belt 5 by the action of the primary transfer roller 8.

For example, during full-color image formation, the above-described image forming process is successively performed at the image forming portions SY, SM, SC and SK. As a result, the toner images for the respective colors formed on the surfaces of the photosensitive drums 1 are successively primary-transferred superposedly onto the outer peripheral surface of the intermediary transfer belt 5.

Thereafter, the recording material 12 is fed toward the secondary transfer portion N in synchronism with rotation of the intermediary transfer belt 5 in the arrow B direction in FIG. 1. The four color toner images formed on the outer peripheral surface of the intermediary transfer belt 5 by the action of the secondary transfer roller 9 contacting the recording material 12 carried on the outer peripheral surface of the intermediary transfer belt 5 are secondary-transferred collectively onto the recording material 12.

The recording material 12 on which the toner images are secondary-transferred is fed to the fixing device 10 as the fixing means. In a period in which the recording material 12 carrying thereon the toner images is nipped and fed by the heating roller and the pressing roller which are provided in the fixing device 10, heat and pressure are applied to the recording material 12 on which the toner images are carried. As a result, the toner images are heat-fixed on the recording material 12.

The primary transfer residual toner remaining on the surface of each of the photosensitive drums 1 after the primary transfer is scraped off and removed by the associated cleaning blade 6 and is collected in the associated residual toner accommodating portion 14*a*. Further, the secondary transfer residual toner remaining on the outer peripheral surface of the intermediary transfer belt 5 after the secondary transfer is removed and collected by the cleaner 11.

The transfer residual toner (waste toner) removed by the cleaner 11 is discharged into an unshown residual (waste) toner box provided in the image forming apparatus 100. The image forming apparatus 100 can be also form a monochromatic (single-color) or multi-color image by using only the image forming portion(s) S for a desired single color or the desired some colors (not all the colors).

<Process Cartridge>

Next, using FIG. 3, a structure of the process cartridge 7 mounted in the image forming apparatus 100 will be described. The photosensitive member unit 13 shown in FIG. 3 includes the cleaning frame 14 as a frame for supporting various elements in the photosensitive member unit 13. By the cleaning frame 14, the photosensitive drum 1 is shaft-supported rotatably in the arrow A direction in FIG. 3 via an unshown bearing member.

The cleaning frame 14 further includes a bearing 15 rotatably supporting the charging roller 2. The bearing 15 is mounted movably in an arrow E direction in FIG. 3 along a rectilinear line 37 passing through a rotation center 2*a* of the charging roller 2 and a rotation center 1*a* of the photosensitive drum 1. The bearing 15 is urged toward the photosensitive drum 1 by an urging force of an urging spring 16 as an urging means.

The cleaning blade 6 is prepared by integrally assembling an elastic member 6*a* for removing the transfer residual toner (waste toner) remaining on the photosensitive drum 1 after the primary transfer and a supporting member 6*b* for supporting the elastic member 6*a*. The residual (waste) toner removed from the surface of the photosensitive drum 1 by the cleaning blade 6 drops in a direction of gravitation (downward direction in FIG. 3) in a space formed by the cleaning blade 6 and the cleaning frame 14, and is accommodated in the residual toner accommodating portion 14*a*.

The developing unit 4 includes a developing (device) frame 18 for supporting various elements in the developing unit 4. The developer container 38 is formed by the developing frame 18. The developing unit 4 is provided with the developing roller 22 as the developer carrying member rotating in an arrow D direction in FIG. 3 in contact with the surface of the photosensitive drum 1. The developing roller 22 is rotatably supported via unshown bearings provided in the developing frame 18, at both end portions thereof with respect to a longitudinal direction (rotational axis direction).

The developing unit 4 includes a developer accommodating chamber (developer accommodating portion) 18*a* for accommodating the toner T (developer), a developing chamber 18*b* provided with the developing roller 22, and an opening 18*c* for permitting communication between the developer accommodating chamber 18*a* and the developing chamber 18*b*. As shown in FIG. 3, in a state in which the process cartridge 7 is mounted at the image forming position of the image forming apparatus 100, the developing chamber 18*b* is positioned above the developer accommodating chamber 18*a*. The opening 18*c* permits communication of an inside of the developer accommodating chamber (developer accommodating portion) 18*a* with the developing chamber 18*b* constituting an outside of the developer accommodating chamber 18*a*.

The developing chamber 18*b* is provided with a supplying roller 20 as a developer supplying member rotating in contact with the surface of the developing roller 22 and a developing blade 21 as a developer regulating member for regulating a layer thickness of the toner T carried on the surface of the developing roller 22. In the developer accommodating chamber 18*a* a stirring member 23 which is a rotatable member not only for stirring the toner T accommodated in the developer accommodating chamber 18*a* but also for feeding the toner T toward the supplying roller 20 in the developing chamber 18*b* via an opening 18*c*.

The stirring member (rotatable member) 23 is supported rotatably in the developer accommodating chamber (developer accommodating portion) 18*a*, and a rotation shaft 23*a* thereof is provided along a longitudinal direction of the developer accommodating chamber (developer accommodating portion) 18*a*. The rotation shaft 23*a* is disposed in parallel to a rotational axis direction of the developing roller 22. Further, a stirring sheet 23*b* including a fixing portion 23*b*1 provided at one end portion is fixed to the rotation shaft 23*a* and including a free end portion 23*b*2 provided at the other end portion is provided in the developer accommodating chamber 18*a*.

The stirring sheet 23*b* is constituted by a flexible sheet-like member. The rotation shaft 23*a* rotates in an arrow F direction in FIG. 3, whereby the stirring sheet 23*b* rotates integrally with the rotation shaft 23*a* and stirs and feeds the toner T accommodated in the developer accommodating chamber 18*a*. The stirring member 23*b* further includes a sealing sheet 24 as a sealing member which is a sheet member which has flexibility and which is elastically deformable. A fixing portion 24*a* which is a first end portion of the sealing sheet (sheet member) 24 is fixed to the rotation shaft 23*a* of the sealing member (rotatable member) 23.

A sealing portion 24*b* which is a second end portion mounted in the developer accommodating chamber (developer accommodating portion) 18*a* in an unused state and peelable off the developer accommodating chamber (developer accommodating portion) 18*a* in a use state is peelably bonded to a peripheral edge portion 18*c*1 of the opening 18*c* on the developer accommodating chamber 18*a* side. The opening 18*c* is provided so as to penetrate through a partition wall 18*h* defining the developer accommodating chamber (developer accommodating portion) 18*a* and the developing chamber (outside) 18*b*. The sealing portion 24*b* is positioned on a side opposite from the fixing portion (first end portion) 24*a*.

In the state in which the process cartridge 7 is unused, the sealing portion 24*b* of the sealing sheet 24 is peelably bonded to the peripheral edge portion of the opening 18*c* on the developer accommodating chamber 18*a* side. As a result, the sealing portion 24*b* of the sealing sheet 24 unsealably seals the opening 18*c*. By this, in the unused state of the process cartridge 7, the toner T accommodated in the developer accommodating chamber 18*a* is prevented from leaking into the developing chamber 18*b* due to vibration or the like during transportation of the process cartridge 7. As a result, the toner T is prevented from leaking out of the developing frame 18 through an opening of the developing frame 18 from which a part of the surface of the developing roller 22 is exposed toward the photosensitive drum 1.

The fixing portion 24*a* of the sealing sheet 24 is fixed to the rotation shaft 23*a*. As shown in FIG. 3, in a state in which the unused process cartridge 7 is mounted at the image forming position of the image forming apparatus 100, a rotational driving force of a motor which is an unshown driving source is transmitted to the rotation shaft 23*a*, so that the rotation shaft 23*a* is rotated in the arrow F direction in FIG. 3. The sealing sheet 24 is wound about the rotation shaft 23*a* at an outer periphery thereof, so that the sealing portion 24*b* peelably bonded to the peripheral edge portion of the opening 18*c* on the developer accommodating chamber 18*a* side is peeled off of the peripheral edge portion of the opening 18*c* on the developer accommodating chamber 18*a* side. That is, the rotation shaft 23*a* moves at least a part of the sealing sheet (sheet member) 24, whereby the opening 18*c* is unsealed.

As shown in FIG. 3, the sealing portion 24*b* is peeled off of the peripheral edge portion of the opening 18*c* by a peeling force with respect to a direction toward the rotation shaft 23*a*. At this time, the sealing portion 24*b* is peeled off from a side (upper peripheral edge portion in FIG. 3) remote from the rotation shaft 23*a*, toward a side (lower peripheral edge portion in FIG. 3) close to the rotation shaft 23*a*. Thus, the sealing sheet (sheet member) 24 is peelably bonded to the peripheral edge portion of the opening 18*c* by being folded back toward the developer accommodating chamber 18*a* side at a fold-back portion 24*c*. As a result, shearing peeling is avoided, so that the sealing portion 24*b* can be peeled off with a small peeling portion.

The sealing sheet 24 in which the sealing portion 24*b* is peeled off rotates integrally with the rotation shaft 23*a* rotating in the arrow F direction in FIG. 3 in a state in which the sealing sheet 24 is wound up along the outer peripheral surface of the rotation shaft 23*a*. As a result, the stirring sheet 23*b* and the sealing sheet 24 rotate integrally with the rotation shaft 23*a*.

The stirring sheet 23*b* rotates in the arrow F direction in FIG. 3. At this time, the stirring sheet 23*b* contacts and slides with an inner wall surface 18*d* of the developer accommodating chamber 18*a* in a flanged state. The inner wall surface 18*d* has a releasing position 18*e* where the stirring sheet 23*b* is released from the flanged state and the developer container 38 projects inwardly.

When the free end portion 23*b*2 of the stirring sheet 23*b* rotating about the rotation shaft 23*a* in the arrow F direction in FIG. 3 passes through the releasing position 18*e*, the stirring sheet 23*b* is released from the flanged state.

By a force generating at that time, the toner T on the stirring sheet 23*b* is leaped upward, so that the toner T is fed toward the supplying roller 20 in the developing chamber 18*b* through the opening 18*c*.

<Developer Container>

Figure 4:
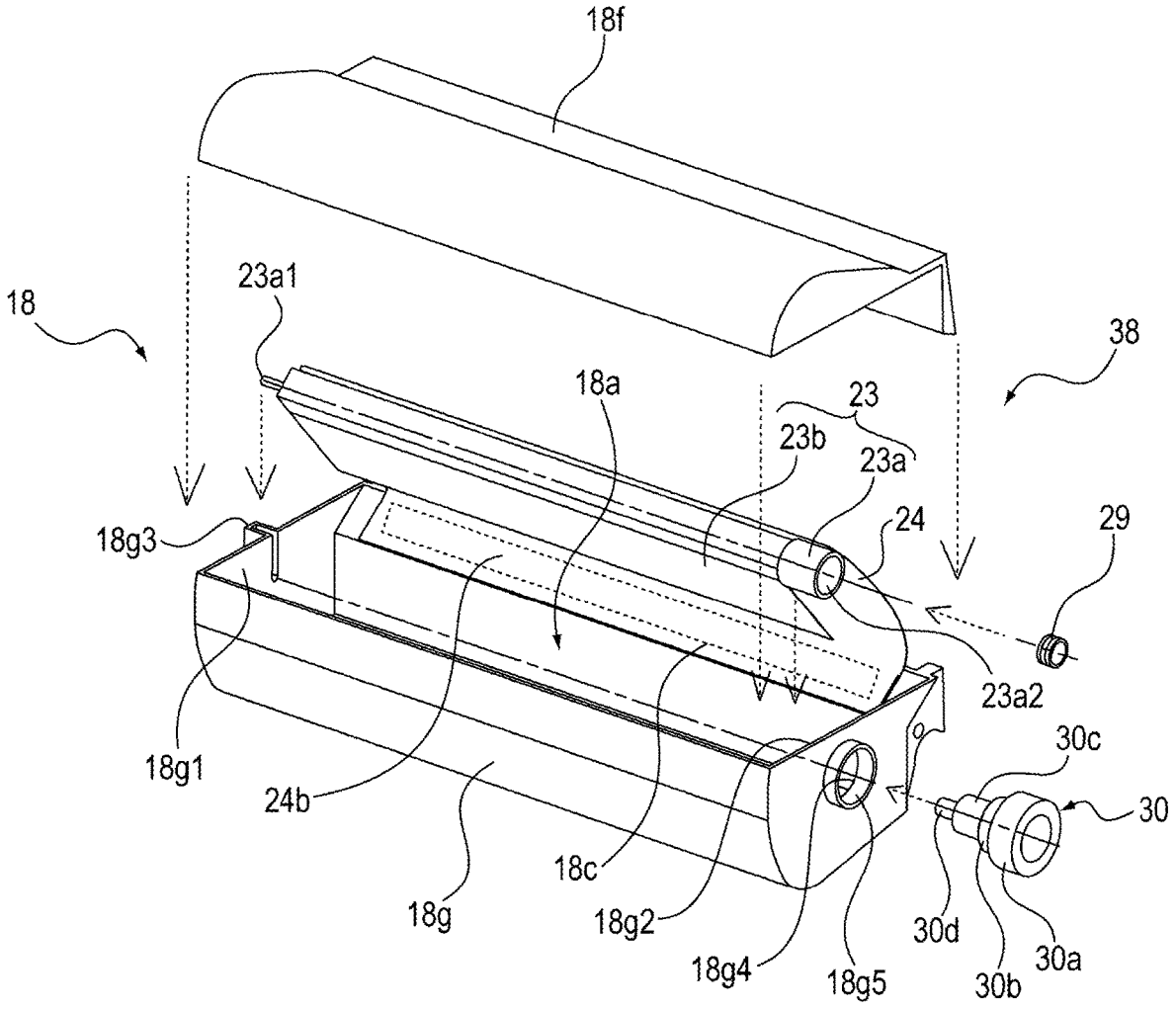
FIG. 4 is an exploded perspective view showing a structure of a developer container in First Embodiment.
Figure 5:
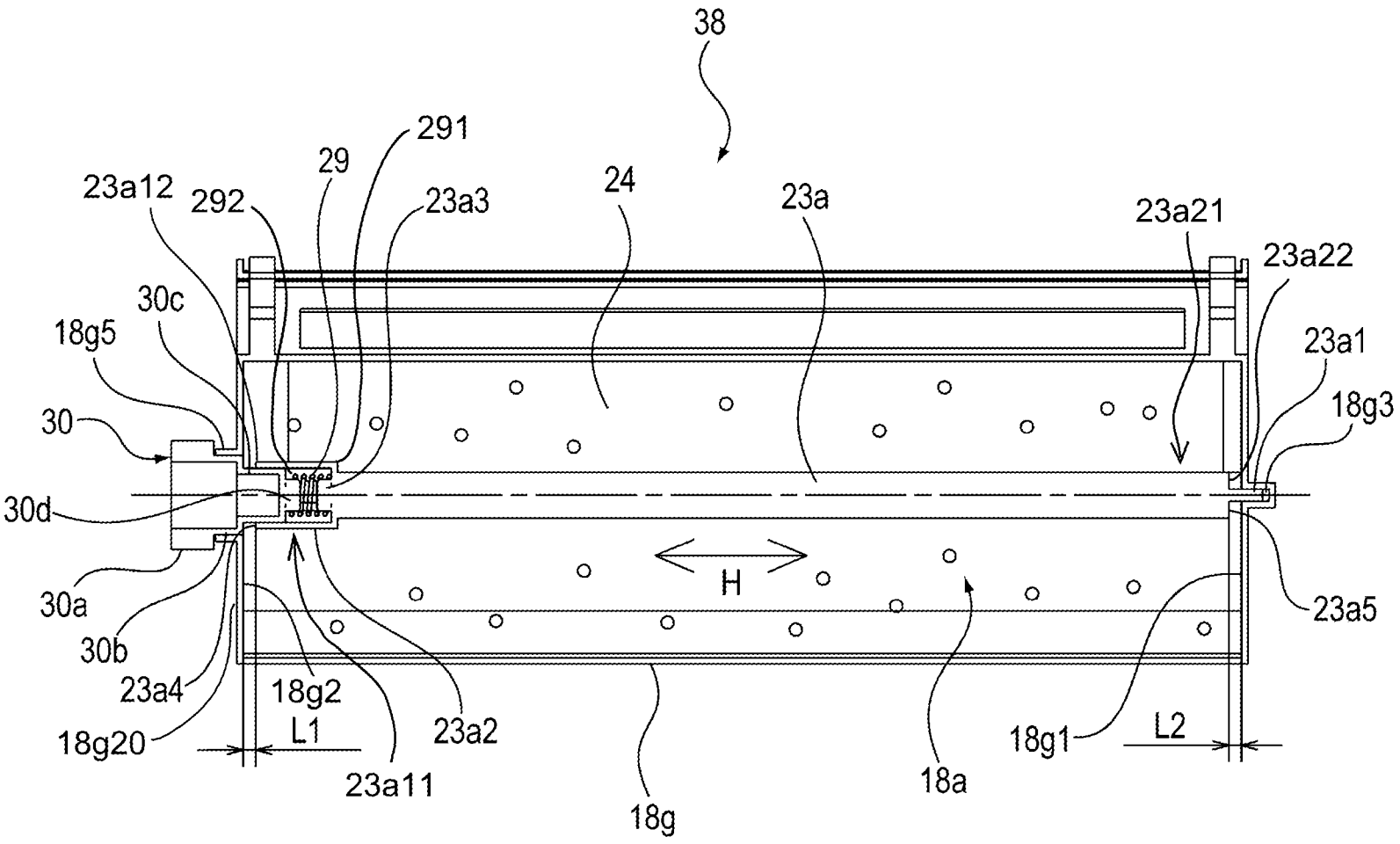
FIG. 5 is a sectional view showing a structure of the developer container in First Embodiment.

Next, using FIGS. 4 and 5, a structure of the developer container 38 will be described. FIG. 4 is an exploded perspective view showing the structure of the developer container 38 in this embodiment. FIG. 5 is a sectional view showing the structure of the developer container 38 in this embodiment. As shown in FIG. 4, in the developer accommodating chamber 18*a* of the developer container 38, the stirring member 23 for feeding the toner T is provided. The developing frame 18 constituting the developer accommodating chamber 18*a* is prepared by integrally assembling a first frame 18*f* and a second frame 18*g* into a unit.

<Assembling of Developer Container>

An assembling procedure of the developer container 38 will be described. First, to the outer peripheral surface of the rotation shaft 23*a* shown in FIG. 4, the fixing portion 23*b*1 of the stirring sheet 23 for stirring and feeding the toner T and the fixing portion 24*a* of the sealing sheet 24 for sealing the opening 18*c* are fixed by a method such as heat fastening. Further, along the peripheral edge portion of the opening 18*c*, the sealing portion 24*b* of the sealing sheet 24 is peelably bonded by a method such as (heat) welding.

At one end portion 23*a*21 of the rotation shaft 23*a* shown in FIGS. 4 and 5 with respect to the rotational axis direction, a sliding shaft 23*a*1 is provided. At the other end portion 23*a*11 of the rotation shaft 23*a* with respect to the rotational axis direction, a cylindrical portion (cover member) 23*a*2 is provided. Inside the cylindrical portion 23*a*2, as shown in FIG. 5, a projected portion 23*a*3 on which one end portion of an elastic member 29 comprising a coil spring is press-fitted is provided.

On an outer peripheral surface of the projected portion 23*a*3 in the cylindrical portion 23*a*2, the one end portion of the elastic member 29 comprising the coil spring is mounted by press-fitting engagement. At this time, the elastic member 29 is press-fitted around the outer peripheral surface of the projected portion 23*a*3 of the rotation shaft 23*a*. As a result, the rotation shaft 23*a* and the elastic member 29 are integrated (combined) with each other. Thus, an integrated member of the rotation shaft 23*a*, the stirring sheet 23*b*, the sealing sheet 24 and the elastic member 29 is the stirring member 23.

Then, the stirring member 23 is mounted in the second frame 18*g*. As shown in FIG. 4, the sliding shaft 23*a*1 of the rotation shaft 23*a* is inserted into a bearing portion 18*g*3 comprising a U-shaped groove provided so as to project outwardly from an inside surface 18*g*1 on a side opposite from a drive transmitting member 30 in the second frame 18*g*. At the same time, the cylindrical portion 23*a*2 is inserted into the second frame 18*g*. At this time, the cylindrical portion 23*a*2 is inserted into the second frame 18*g* until a bearing portion 18*g*5 comprising a cylindrical portion provided so as to project outwardly from a peripheral edge portion of a through hole 18*g*4 formed so as to penetrate an inside surface 18*g*2 at the other end portion of the second frame 18*g* with respect to the longitudinal direction opposes the cylindrical portion 23*a*2.

The drive transmitting member 30 for transmitting drive (driving force) to the stirring member (rotatable member) 23 is rotatably supported by the inside surface 18*g*2 (side wall 18*g*20) on one end side of the developer accommodating chamber (developer accommodating portion) 18*a*. The elastic member 29 is fixed at one end portion 291 thereof to the rotation shaft 23*a* of the stirring member (rotatable member) 23 with respect to the longitudinal direction and is fixed at the other end portion 292 thereof to the drive transmitting member 30.

To the stirring member 23, a rotational driving force from an unshown motor which is a driving source is transmitted by the drive transmitting member 30. The drive transmitting member 30 transmits drive (rotational driving force) to the rotation shaft 23*a*. The drive transmitting member 30 includes a gear portion 30*a* to which the rotational driving force from the unshown motor (driving source) is transmitted. Further, the drive transmitting member 30 includes a sliding portion 30*b* contactable and slidable with the bearing portion 18*g*5 which is a cylindrical portion provided in the second frame 18*g* by being inserted into the bearing portion 18*g*5.

The drive transmitting member 30 further includes an engaging portion 30*c* to be engaged into the cylindrical portion 23*a*2 provided on the rotation shaft 23*a*. Further, the drive transmitting member 30 includes a projected portion 30*d* to which the other end portion of the elastic member 29 is to be mounted by the press-fitting engagement. Thus, the drive transmitting member 30 is constituted.

As shown in FIG. 4, from an outside of the developer accommodating chamber 18*a*, the projected portion 30*d*, the engaging portion 30*c* and the sliding portion 30*b* of the drive transmitting member 30 are inserted into the through hole 18*g*4. At this time, as shown in FIG. 5, the projected portion 30*d* is press-fitted into the other end portion of the elastic member 29 including one end portion press-fitted around the outer peripheral surface of the projected portion 23*a*3. Further, the engaging portion 30*c* is engaged in the cylindrical portion 23*a*2 of the rotation shaft 23*a*. Further, the sliding portion 30*b* is engaged in the bearing portion 18*g*5.

As a result, one end portion of the elastic member 29 is fixed to the projected portion 23*a*3 of the rotation shaft 23*a* by the press-fitting engagement, and the other end portion of the elastic member 29 is fixed to the projected portion 30*d* of the drive transmitting member 30 by the press-fitting engagement. As a result, when the rotational driving force from the unshown motor (driving source) is transmitted to the gear portion 30*a* of the drive transmitting member 30, the rotational driving force is transmitted from the projected portion 30*d* to the projected portion 23*a*3 of the rotation shaft 23*a* via the elastic member 29. The cylindrical portion 23*a*2 is constituted as a cover member for covering the outer peripheral surface of the elastic member 29. The outer peripheral surface of the elastic member 29 is covered by the cylindrical portion 23*a*2, so that an expansion and contraction operation of the elastic member 29 is not impaired by the toner T in the developer accommodating chamber 18*a*.

The elastic member 29 is disposed between the end portion of the stirring member (rotatable member) 23 and the inside surface 18*g*2 of the developer accommodating chamber (developer accommodating portion) 18*a* with respect to the longitudinal direction of the developer accommodating chamber (developer accommodating portion) 18*a*. The elastic member 29 comprising the coil spring is elastically deformable in the longitudinal direction of the developer accommodating chamber (developer accommodating portion) 18*a*.

As shown in FIG. 5, the bearing portion 18*g*3 comprising the U-shaped groove provided in the inside surface 18*a*1 of the second frame 18*g* on the side opposite from the drive transmitting member 30 is provided so as to project from the inside surface 18*g*1 toward the outside by a distance in which the rotation shaft 23*a* is movable in the rotational axis direction. Further, the sliding shaft 23*a*1 of the rotation shaft 23 is rotatably shaft-supported by the bearing portion 18*g*3 so as to be slidable in the rotational axis direction of the rotation shaft 23*a*. Further, the cylindrical portion 23*a*2 of the rotation shaft 23*a* is engaged with the engaging portion 30*c* of the drive transmitting member 30 so as to be slidable in the rotational axis direction of the rotation shaft 23*a*. As a result, the rotation shaft 23*a* is rotatably shaft-supported by the developer container 38 so as to be slidable in the rotational axis direction of the rotation shaft 23*a*.

As shown in FIG. 5, the one end portion of the elastic member 29 is press-fitted around the projected portion 30*d* of the drive transmitting member 30, and therefore, the drive transmitting member 30 and the elastic member 29 are integrated (combined) with each other. Further, the other end portion of the elastic member 29 is press-fitted around the projected portion 23*a*3 of the rotation shaft 23*a*, and therefore, the rotation shaft 23*a* and the elastic member 29 are integrated with each other.

The rotational driving force from the unshown motor (driving source) is transmitted to the gear portion 30*a* of the drive transmitting member 30. Then, the rotational driving force is transmitted to the rotation shaft 23*a* via the projected portion 30*d* of the drive transmitting member 30, the elastic member 29 and the projected portion 23*a*3 of the rotation shaft 23*a*. As a result, the stirring member 23 is rotated about the rotation shaft 23*a* in the arrow F direction in FIG. 3.

The rotation shaft 23*a* of the stirring member 23, the elastic member 29 and the drive transmitting member 30 are integrated with each other, so that the rotation shaft 23*a* is supported movably in the rotational axis direction of the rotation shaft 23*a* shown by an arrow H direction in FIG. 5 depending on an elastic force of the elastic member 29. Thereafter, the first frame 18*f* and the second frame 18*g* which are shown in FIG. 4 are bonded to each other, and then, the toner T is charged into the developer accommodating chamber 18*a* through an unshown toner charging opening. Thereafter, the unshown toner charging opening is closed.

As shown in FIG. 5, the developer container 38 is completed, and as shown in FIG. 5, in an attitude such that the developer container 38 is laterally placed so that the rotational axis direction of the stirring member 23 is a horizontal direction, the elastic member 29 is disposed with a free length. At this time, not only a compression force but also a tensile force do not act on the elastic member 29.

At this time, with respect to the longitudinal direction of the developer accommodating chamber (developer accommodating portion) 18*a*, an end portion 23*a*4 (end surface 23*a*12) of the cylindrical portion 23*a*2 provided at the one end portion 23*a*11 of the rotation shaft 23*a* of the stirring member (rotatable member) 23 with respect to the rotational axis direction, and the inside surface 18*g*2 of the developer accommodating chamber (developer accommodating portion) 18*a* will be considered. Between these portions (surfaces), a gap (clearance) L1 in which the stirring member (rotatable member) 23 is movable relative to the developer accommodating chamber (developer accommodating portion) 18*a* is formed.

Further, with respect to the longitudinal direction of the developer is accommodating chamber (developer accommodating portion) 18*a*, a base portion 23*a*5 (end surface 23*a*22) of the sliding shaft 23*a*1 provided at the other end portion 23*a*21 of the rotation shaft 23*a* of the stirring member (rotatable member) 23 with respect to the rotational axis direction, and the inside surface 18*g*1 of the developer accommodating chamber (developer accommodating portion) 18*a* will be considered. Between these portions (surfaces), a gap (clearance) L2 in which the stirring member (rotatable member) 23 is movable relative to the developer accommodating chamber (developer accommodating portion) 18*a* is formed. Thus, in this embodiment, assembling of the stirring member 23 with the second frame 18*g* becomes easy, and therefore, an assembling property is improved.

<During Transportation>

Next, using FIGS. 6 and 7, behavior of the toner T in the developer container 38 when the process cartridge 7 is transported will be described. Part (a) of FIG. 6 is a sectional view showing a state in which the developer container 38 is transported with the drive transmitting member 30 facing downward. Part (b) of FIG. 6 is a sectional view for illustrating a behavior of the sealing sheet 24 in the case where the developer container 38 is transported with the drive transmitting member 30 facing downward. Part (c) of FIG. 6 is a partially perspective view of the sealing sheet 24 as seen from a lower side of part (b) of FIG. 6. Part (a) of FIG. 7 is a sectional view showing a state in which the developer container 38 is transported with the drive transmitting member 30 facing upward. Part (b) of FIG. 7 is a sectional view for illustrating a behavior of the sealing sheet 24 in the case where the developer container 38 is transported with the drive transmitting member 30 facing upward. Part (c) of FIG. 7 is a partially perspective view of the sealing sheet 24 as seen from an upper side of part (b) of FIG. 7.

As shown in part (a) of FIG. 6 and part (a) of FIG. 7, a vertically placed state of the developer container 38 in which the rotational axis direction of the rotation shaft 23*a* of the stirring member 23 of the process cartridge 7 is a direction of gravitation (up-down direction in part (a) of FIG. 6 and part (a) of FIG. 7) will be considered. In this state, the case where the process cartridge 7 is transported will be considered. Incidentally, for easy to understand behavior of respective component parts by vibration during transportation, in FIGS. 6 and 7, the developer accommodating chamber 18*a*, the rotation shaft 23*a*, the sealing sheet 24, the elastic member 29 and the drive transmitting member 30 of the developer container 38 are illustrated and other component parts are omitted from illustration.

As shown in part (a) of FIG. 6, in the case where the process cartridge 7 is transported with the drive transmitting member 30 facing downward, the rotation shaft 23*a* is movable (swingable) in the rotational axis direction thereof shown as an arrow H direction in part (a) of FIG. 6 depending on compression and tension of the elastic member 29. By transportation of the process cartridge 7, vibration is transmitted to the developer container 38 in the same direction as the rotational axis direction of the rotation shaft 23*a* shown as the arrow H direction in part (a) of FIG. 6. Then, the elastic member 29 is compressed by acceleration of the vibration, a weight of the rotation shaft 23*a* and a weight of the toner T deposited on the rotation shaft 23*a*.

By compression of the elastic member 29, the rotation shaft 23*a* moves toward the inside surface 18*g*2 side (the drive transmitting member 30 side) of the developer accommodating chamber 18*a*. As a result, a gap L1, with respect to the rotational axis direction of the rotation shaft 23*a* of the stirring member 23, formed between the inside surface 18*g*2 of the developer accommodating chamber 18*a* and the end portion 23*a*4 of the cylindrical portion 23*a*2 provided at the end portion of the rotation shaft 23*a* with respect to the longitudinal direction becomes smaller than the gap L1 in a laterally placed state shown in FIG. 5.

Thereafter, the compressed state of the elastic member 29 is restored to the original state, whereby the rotation shaft 23*a* moves in a direction in which the rotation shaft 23*a* is spaced from the inside surface 18*g*2 side (the drive transmitting member 30 side) of the developer accommodating chamber 18*a*. At this time, the gap L1 extends in a direction in which the state of the elastic member 29 returns to the original state. As long as the vibration during the transportation of the process cartridge 7 is continued, the rotation shaft 23*a* repeats a swing such that the rotation shaft 23*a* reciprocates in the rotational axis direction of the rotation shaft 23*a* shown as the arrow H direction in part (a) of FIG. 6. That is, when the rotation shaft 23*a* moves in the rotational axis direction by the vibration during the transportation of the process cartridge, the rotation shaft 23*a* is moved by an elastic force of the elastic member 29 in a direction opposite to the movement of the rotation shaft 23*a*.

The rotation shaft 23*a* performs reciprocating swing thereof in the rotational axis direction shown as the arrow H direction in part (a) of FIG. 6. Then, the toner contacting the rotation shaft 23*a* and the toner T around the rotation shaft 23*a* perform reciprocating swing in the rotational axis direction shown as the arrow H direction in part (a) of FIG. 6 depending on motion of the rotation shaft 23*a*. As a result, even when the developer container 38 is in the vertically placed state, agglomeration of the toner T due to localization of the toner T to the inside surface 18*g*2 side (the drive transmitting member 30 side) of the developer accommodating chamber 18*a* is suppressed.

Behavior of the sealing sheet 24 at this time will be described using parts (a) to (c) of FIG. 6. As shown in part (a) of FIG. 6, the fixing portion 24*a* side of the sealing sheet 24 fixed to the rotation shaft 23*a* moves integrally with the rotation shaft 23*a* in the arrow H direction in part (a) of FIG. 6. The sealing portion 24*b* side of the sealing sheet 24 is in a state in which the sealing portion 24*b* is fixed at the peripheral edge portion of the opening 18*c*. For this reason, the sealing sheet 24 having flexibility follows the motion of the rotation shaft 23*a* in the arrow H direction in part (a) of FIG. 6 while flexing.

At this time, as shown in part (b) of FIG. 6, a part of the fixing portion 24*a* of the sealing sheet 24 fixed to the rotation shaft 23*a* causes flexure with respect to an arrow M direction and an arrow N direction in part (b) of FIG. 6. As a result, the toner T contacting the sealing sheet 24 is loosened, so that localized agglomeration is suppressed.

In the unused state, the sealing sheet (sheet member) 24 is elastically deformed together with the elastic member 29 with movement of the stirring member (rotatable member) 23 relative to the developer accommodating chamber (developer accommodating portion 18*a* in the longitudinal direction of the developer accommodating chamber (developer accommodating portion) 18*a*.

In the longitudinal direction of the developer accommodating chamber (developer accommodating portion) 18*a*, the stirring member (rotatable member) 23 moves relative to the developer accommodating chamber 18*a*. At that time, the elastic member 29 is constituted so as to generate an urging force to the stirring member (rotatable member) 23 in a direction opposite to the movement direction of the stirring member (rotatable member) 23.

The longitudinal direction of the developer accommodating chamber (developer accommodating portion) 18*a* will be considered. The elastic member 29 is an example in which a single elastic member is provided between the end portion of the stirring member 23 on one side and the inside surface 18*g*2 of the developer accommodating chamber 18*a* on one side opposing the end portion of the stirring member 23 on the one side.

A thickness of the sealing sheet 24 in this embodiment is in a range of 30 μm-60 μm. As a result, when the rotation shaft 23*a* is moved in the rotational axis direction by the vibration during the transportation of the process cartridge 7, the sealing sheet 24 properly flanges, so that the toner T contacting the sealing sheet 24 is easily loosened.

Part (a) of FIG. 7 shows behavior of the toner T in the developer container 38 in the case where the developer container 7 is transported with the drive transmitting member 30 facing upward. During transportation of the process cartridge 7, vibration is transmitted to the developer container 38 in the same direction as the rotational axis direction of the rotation shaft 23*a* shown as the arrow H direction in part (a) of FIG. 7. Then, the elastic member 29 is stretched by acceleration of the vibration, a weight of the rotation shaft 23*a* and a weight of the toner T deposited on the rotation shaft 23*a*.

By stretch of the elastic member 29, the rotation shaft 23*a* moves toward the inside surface 18*g*1 side (opposite from the drive transmitting member 30 side) of the developer accommodating chamber 18*a*. Here, a gap L2, with respect to the rotational axis direction of the rotation shaft 23*a* of the stirring member 23, formed between the inside surface 18*g*1 of the developer accommodating chamber 18*a* and the base portion 23*a*5 of the sliding shaft 23*a*1 provided at the other end portion of the rotation shaft 23*a* with respect to the longitudinal direction will be considered. The gap L2 at this time becomes smaller than the gap L2 in a laterally placed state shown in FIG. 5.

Thereafter, the stretched state of the elastic member 29 is restored to the original state, whereby the rotation shaft 23*a* moves in a direction in which the rotation shaft 23*a* is spaced from the inside surface 18*g*1 side (opposite from the drive transmitting member 30 side) of the developer accommodating chamber 18*a*. As a result, the gap L2 extends in a direction in which the state of the elastic member 29 returns to the original state. As long as the vibration during the transportation of the process cartridge 7 is continued, the rotation shaft 23*a* repeats a swing such that the rotation shaft 23*a* reciprocates in the rotational axis direction of the rotation shaft 23*a* shown as the arrow H direction in part (a) of FIG. 7.

The rotation shaft 23*a* performs reciprocating swing thereof in the rotational axis direction shown as the arrow H direction in part (a) of FIG. 7. Then, the toner contacting the rotation shaft 23*a* and the toner T around the rotation shaft 23*a* perform reciprocating swing in the rotational axis direction shown as the arrow H direction in part (a) of FIG. 7 depending on motion of the rotation shaft 23*a*. As a result, agglomeration of the toner T localized on the inside surface 18*g*1 side (opposite from the drive transmitting member 30 side) of the developer accommodating chamber 18*a* is suppressed.

Behavior of the sealing sheet 24 at this time will be described using parts (a) to (c) of FIG. 7. As shown in part (a) of FIG. 7, the fixing portion 24*a* side of the sealing sheet 24 fixed to the rotation shaft 23*a* moves integrally with the rotation shaft 23*a*. The sealing portion 24*b* side of the sealing sheet 24 is in a state in which the sealing portion 24*b* is fixed at the peripheral edge portion of the opening 18*c*. For this reason, the sealing sheet 24 having flexibility follows the motion of the rotation shaft 23*a* while flexing. At this time, a part of the fixing portion 24*a* of the sealing sheet 24 fixed to the rotation shaft 23*a* causes flexure with respect to an arrow M direction and an arrow N direction in part (b) of FIG. 7. As a result, the toner T contacting the sealing sheet 24 is loosened, so that localized agglomeration is suppressed.

In this embodiment, the stirring member 23 provided in the developer container 38 was constituted so as to be swingable in the rotational axis direction of the rotation shaft 23*a*. As a result, the stirring member 23 swings in the rotational axis direction of the rotation shaft 23*a* by the vibration during the transportation or the like. As a result, the toner T accommodated in the developer container 38 is loosened, so that the agglomeration of the toner T can be suppressed.

In this embodiment, the projected portion 30*d* of the drive transmitting member 30 for transmitting the rotational driving force to the stirring member 23 and the projected portion 23*a*3 of the rotation shaft 23*a* of the stirring member 23 are press-fitted into the end portions of the elastic member 29 comprising the coil spring. As a result, the rotational driving force of the drive transmitting member 30 is transmitted to the rotation shaft 23*a* of the stirring member 23 via the elastic member 29.

Further, when the process cartridge 7 is transported in the vertically placed state in which the attitude of the developer container 38 is such that the rotational axis direction of the rotation shaft 23*a* extends along the direction of gravitation, the elastic member 29 is compressed or stretched by the vibration during the transportation, so that the rotation shaft 23*a* swings along the rotational axis direction (the direction of gravitation). As a result, the flexible sealing sheet 24 fixed to the rotation shaft 23*a* on the fixing portion 24*a* side and fixed to the peripheral edge portion of the opening 18*c* on the sealing portion 24*b* side flanges with the swing of the rotation shaft 23*a*. The toner T (developer) accommodated in the developer container 38 is loosened by repetition of the swing of the rotation shaft 23*a* and the flexure of the sealing sheet 24, so that the agglomeration of the toner T is suppressed.

In this embodiment, the elastic member 29 swingably supporting the rotation shaft 23*a* also functions as a part of a drive transmitting path along which the rotational driving force is transmitted from the drive transmitting member 30 to the rotation shaft 23*a*. For this reason, there is no need to separately provide a member for loosening the toner T (developer) in addition to the stirring member 23. For this reason, a structure is simple and a volume of the inside of the developer container 38 is prevented from lowering correspondingly to a volume of a separately provided member.

Further, in this embodiment, the drive transmitting member 30 and the rotation shaft 23*a* are connected by the elastic member 29, and therefore, the influence of the swing of the rotation shaft 23*a* in the rotational axis direction on the drive transmitting member 30 is small. For this reason, the drive transmitting member 30 is shaft-supported at a certain position by the bearing portion 18*g*5. For this reason, there is no need to employ a constitution in which the shaft portion of the drive transmitting portion has a length for permitting an amount of the movement of the stirring shaft in the rotational axis direction, so that upsizing of the developer container 38 is also prevented.

Second Embodiment

Next, a constitution of Second Embodiment in which a developer container 38 according to the present invention, a developing device and a process cartridge 7 are used will be described using FIGS. 8 to 11. Incidentally, portions or members constituted similarly as in First Embodiment will be omitted from description by adding the same reference numerals or symbols or by adding the same member (portion) names even when the reference numerals or symbols are different from those in First Embodiment.

<Developer Container>

Using FIGS. 8 and 9, a structure of the developer container 38 will be described. FIG. 8 is an exploded perspective view showing the structure of the developer container 38 in this embodiment. FIG. 9 is a sectional view showing the structure of the developer container 38 in this embodiment. As shown in FIG. 8, the developing frame 18 constituting the developer accommodating chamber 18*a* is prepared by integrally assembling a first frame 18*f* and a second frame 18*g* into a unit. In the developer accommodating chamber (developer accommodating portion) 18*a* of the developer container 38, the stirring member 23 for stirring and feeding the toner T is provided.

At one end portion of the rotation shaft 23*a* of the stirring member 23, with respect to the rotational axis direction a flange portion 23*a*6 and an engaging hole 23*a*7 are provided. Further, at the other end portion of the rotation shaft 23*a* with respect to the rotational axis direction, a sliding shaft 23*a*1 and a flange portion 23*a*8 positioned at a base portion of the sliding shaft 23*a*1 are provided. The drive transmitting member 30 is constituted by including a gear portion 30*a* and a shaft portion 30*e*.

<Assembling of Developer Container>

An assembling procedure of the developer container 38 will be described. First, as shown in FIG. 8, to the outer peripheral surface of the rotation shaft 23*a* shown in FIG. 4, the fixing portion 23*b*1 of the stirring sheet 23 for stirring and feeding the toner T and the fixing portion 24*a* of the sealing sheet 24 for sealing the opening 18*c* are fixed by a method such as heat fastening. Further, along the peripheral edge portion of the opening 18*c*, the sealing portion 24*b* of the sealing sheet 24 is peelably bonded by a method such as (heat) welding.

As shown in FIG. 8, on the outer peripheral surface of the sliding shaft 23*a*1 of the rotation shaft 23*a*, a second elastic member 32 comprising a coil spring is engaged. Thereafter, the sliding shaft 23*a*1 of the rotation shaft 23*a* is inserted into the bearing portion 18*g*3 comprising the U-shaped groove provided in the inside surface 18*g*1 of the second frame 18*g* on the side opposite from the drive transmitting member 30.

At this time, as shown in FIG. 9, the second elastic member 32 engaged on the outer peripheral surface of the sliding shaft 23*a*1 is disposed between the inside surface 18*g*1 of the second frame 18*g* on the side opposite from the drive transmitting member 30 and the flange portion 23*a*8 provided on the rotation shaft 23*a*. That is, arrangement of the second elastic member 32 with respect to the rotational axis direction of the rotation shaft 23*a* will be considered.

The longitudinal direction of the developer accommodating chamber (developer accommodating portion) 18*a* will be considered. The second elastic member 32 is disposed between the flange portion 23*a*8 which is an end portion of the stirring member (rotatable member) 23 on the other side and the inside surface 18*g*1, of the developer accommodating chamber (developer accommodating portion) 18*a* on the other side, opposing the flange portion 23*a*8.

Here, the flange portion 23*a*8 is provided on the side (the other side) opposite from the drive transmitting member 30 with respect to the rotational axis direction of the rotation shaft 23*a*. Further, the inside surface 18*g*1 is a second inside surface positioned on the side opposite from the first inside surface (inside surface 18*g*2) of the developer accommodating chamber (developer accommodating portion) 18*a* and is provided on the side opposite from the drive transmitting member 30 of the second frame 18*g*.

As shown in FIG. 8, the bearing portion 18*g*3 comprising the U-shaped groove provided in the inside surface 18*a*1 of the second frame 18*g* on the side opposite from the drive transmitting member 30 is provided so as to project from the inside surface 18*g*1 toward the outside by a distance in which the rotation shaft 23*a* is movable in the rotational axis direction. Further, the sliding shaft 23*a*1 of the rotation shaft 23 is rotatably shaft-supported by the bearing portion 18*g*3 so as to be slidable in the rotational axis direction of the rotation shaft 23*a*.

Thereafter, the shaft portion 30*e* of the drive transmitting member 30 is inserted into the cylindrical bearing portion 18*g*5 and is further passed through the through hole 18*g*4. In that state, the flange portion 23*a*6 side of the rotation shaft 23*a* is inserted into the second frame 18*g* and, the rotation shaft 23*a* is disposed at a position where the engaging hole 23*a*7 thereof coincides with the through hole 18*g*4 penetrating through the inside surface 18*g*2 at the other end portion of the second frame 18*g* with respect to the longitudinal direction of the second frame 18*g*.

Then, inside the developer accommodating chamber 18*a*, a first elastic member 31 comprising a coil spring is engaged on an outer peripheral surface of the shaft portion 30*e*, and thereafter, the shaft portion 30*e* is press-fitted into the engaging hole 23*a*7. The shaft portion 30*e* of the drive transmitting member 30 is rotatably shaft-supported so as to be slidable in the cylindrical bearing portion 18*g*5 in the rotational axis direction of the rotation shaft 23*a*. Further, the shaft portion 30*e* of the drive transmitting member 30 is press-fitted into the engaging hole 23*a*7 of the rotation shaft 23*a*. As a result, the rotation shaft 23*a* is rotatably shaft-supported by the developer container 38 so as to be slidable in the rotational axis direction of the rotation shaft 23*a*.

At this time, the first elastic member 31 engaged around the outer peripheral surface of the shaft portion 30*e* is, as shown in FIG. 9, disposed between the inside surface 18*g*2 of the second frame 18*g* on the drive transmitting member 30 side with respect to the longitudinal direction and the flange portion 23*a*6. That is, arrangement of the rotation shaft 23*a* of the first elastic member 31 with respect to the rotational axis direction will be considered. The first elastic member 31 is disposed between the flange portion 23*a*6 provided at one end portion of the rotation shaft 23*a* and the inside surface 18*g*2 which is a first inner surface of the developer accommodating chamber (developer accommodating portion) 18*a* on the drive transmitting member 30 side of the second frame 18*g*.

As a result, the one end portion of the rotation shaft 23*a* with respect to the rotational axis direction shown as the arrow H direction in FIG. 9 is bonded to the drive transmitting member 30. The rotation shaft 23*a* extends in the longitudinal direction (left-right direction in FIG. 9) of the developer container 38, so that the rotational axis direction of the rotation shaft 23*a* shown as the arrow H direction in FIG. 9 substantially coincides with the longitudinal direction of the developer container 38.

The first and second elastic members 31 and 32 are disposed, with respect to the longitudinal direction of the developer accommodating chamber (developer accommodating portion) 18*a*, between the one end portion of the stirring member (rotatable member) 23 and the inside surface 18*g*2 and between the other end portion of the stirring member 23 and the inside surface 18*g*1, respectively. The first and second elastic members 31 and 32 are provided so that these members are capable of being expanded and contracted in the rotational axis direction of the rotation shaft 23*a* shown as the arrow H direction in FIG. 9.

The first elastic member 31 does not engage with the inside surface 18*g*2 of the second frame 18*g* on the drive transmitting member 30 side and the flange portion 23*a*6 of the rotation shaft 23*a*. Further, the second elastic member 32 does not engage with the inside surface 18*g*1 of the second frame 18*g* on the side opposite from the drive transmitting member 30 and the flange portion 23*a*8 of the rotation shaft 23*a*. The first frame 18*f* and the second frame 18*g* which are shown in FIG. 8 are bonded to each other, and the toner T is charged in the developer accommodating chamber 18*a* through the unshown toner charging opening. Thereafter, the unshown toner charging opening is closed, so that the developer container 38 is prepared.

The first elastic member 31 and the second elastic member 32 impart elastic forces to the rotation shaft 23*a* along the rotational axis direction of the rotation shaft 23*a* shown as the arrow H direction in FIG. 9. The position of the rotation shaft 23*a* with respect to the rotational axis direction of the rotation shaft 23*a* shown as the arrow H direction in FIG. 9 is determined by a balance between the elastic force received by the flange portion 23*a*6 from the elastic member 31 and the elastic force received by the flange portion 23*a*8 from the elastic member 32. As a result, in a state in which the process cartridge 7 in this embodiment is mounted at the image forming position of the image forming apparatus, a position of the gear portion 30*a* of the drive transmitting member 30 is determined as the position shown in FIG. 9 by the balance between the elastic forces of the first elastic member 31 and the second elastic member 32.

As shown in FIG. 9, an attitude of the developer container 38 in which the rotational axis direction of the rotation shaft 23*a* is the horizontal direction will be considered. At this time, a gap L1 is generated with respect to the rotational axis direction (left-right direction in FIG. 9) of the rotation shaft 23*a* between the inside surface 18*g*2 of the second frame 18*g* on the drive transmitting member 30 side and the flange portion 23*a*6 of the rotation shaft 23*a*.

On the other hand, a gap L2 is generated with respect to the rotational axis direction (left-right direction in FIG. 9) of the rotation shaft 23*a* between the inside surface 18*g*2 of the second frame 18*g* on the side opposite from the drive transmitting member 30 and the flange portion 23*a*8 of the rotation shaft 23*a*. Accordingly, the rotation shaft 23*a* is constituted so as to be swingable in the rotational axis direction of the rotation shaft 23*a* shown as the arrow H direction in FIG. 9 depending on interaction between the elastic force received by the flange portion 23*a*6 from the first elastic member 31 and the elastic force received by the flange portion 23*a*8 from the second elastic member 32. Thus, also in this embodiment, assembling of the stirring member 23 with the second frame 18*g* becomes easy, and therefore, an assembling property is improved.

<During Transportation>

Next, using FIGS. 10 and 11, behavior of the toner T in the developer container 38 when the process cartridge 7 in this embodiment is transported will be described. In FIGS. 10 and 11, behavior of the toner T in the developer container 38 in the case where the process cartridge 7 is transported in the vertically placed state in which the rotational axis direction of the rotation shaft 23*a* of the stirring member 23 provided in the developer container 38 of the process cartridge 7 extends along the direction of gravitation is shown.

Part (a) of FIG. 10 is a sectional view showing a state in which the developer container 38 in this embodiment is transported with the drive transmitting member 30 facing downward. Part (b) of FIG. 10 is a sectional view for illustrating a behavior of the sealing sheet 24 in the case where the developer container 38 in this embodiment is transported with the drive transmitting member 30 facing downward. Part (c) of FIG. 10 is a partially perspective view of the sealing sheet 24 as seen from a lower side of part (b) of FIG. 10. Part (a) of FIG. 11 is a sectional view showing a state in which the developer container 38 in this embodiment is transported with the drive transmitting member 30 facing upward. Part (b) of FIG. 11 is a sectional view for illustrating a behavior of the sealing sheet 24 in the case where the developer container 38 in this embodiment is transported with the drive transmitting member 30 facing upward. Part (c) of FIG. 11 is a partially perspective view of the sealing sheet 24 as seen from a upper side of part (b) of FIG. 11.

As shown in part (a) of FIG. 6 and part (a) of FIG. 7, a vertically placed state of the developer container 38 in which the rotational axis direction of the rotation shaft 23*a* of the stirring member 23 of the process cartridge 7 is a direction of gravitation (up-down direction in part (a) of FIG. 6 and part (a) of FIG. 7) will be considered. In this state, the case where the process cartridge 7 is transported will be considered. Incidentally, in FIGS. 10 and 11, for easy to understand behavior of respective component parts in the developer container 38, the developer container 38, the rotation shaft 23*a*, the sealing sheet 24, the drive transmitting member 30, the first elastic member 31 and the second elastic member 32 will be described with illustration.

As shown in part (a) of FIG. 10, the case where the process cartridge 7 is transported with the drive transmitting member 30 facing downward, will be considered. In this case, the rotation shaft 23*a* is movable in the rotational axis direction thereof shown as an arrow H direction in part (a) of FIG. 10 depending on each of the elastic forces of the first elastic member 31 and the second elastic member 32.

By transportation of the process cartridge 7, vibration is transmitted to the developer container 38 in the same direction as the rotational axis direction of the rotation shaft 23*a* shown as the arrow H direction in part (a) of FIG. 10. Acceleration of the vibration, a weight of the rotation shaft 23*a* and a weight of the toner T deposited on the rotation shaft 23*a* at this time will be considered. At this time, the gap L1 formed, with respect to the rotational axis direction (up-down direction in FIGS. 10 and 11) of the rotation shaft 23*a*, between the inside surface 18*g*2 of the second frame 18*g* on the drive transmitting member 30 side and the flange portion 23*a*6 of the rotation shaft 23*a* will be considered. The gap L1 at this time becomes smaller than the gap L1 in the attitude shown in FIG. 9 such that the rotational axis direction of the rotation shaft 23*a* of the developer container 38 is the horizontal direction.

At this time, the first elastic member 31 is compressed. On the other hand, the second elastic member 32 has a substantially natural length. Thereafter, the compressed state of the first elastic member 31 is restored to the original state. At this time, the elastic force of the first elastic member 31 acts on the rotation shaft 23*a*. As a result, the rotation shaft 23*a* is moved in a direction (upward direction in part (a) of FIG. 10) in which the rotation shaft 23*a* is spaced from the inside surface 18*g*2 of the second frame 18*g* on the drive transmitting member 30 side, so that the gap L1 is extended in a direction in which the state of the first elastic member 31 is returned to the original state.

In a period in which the vibration during the transportation of the process cartridge 7 is continued, the rotation shaft 23*a* repeats movement in the direction in which the gap L1 becomes small and movement in the direction in which the state of the first elastic member 31 is returned to the original state. That is, the rotation shaft 23*a* repeats swing such that the rotation shaft 23*a* reciprocates in the rotational axis direction thereof shown as the arrow H direction in part (a) of FIG. 10. The case where the flange portion 23*a*6 of the rotation shaft 23*a* is moved in the direction (upward direction in part (a) of FIG. 10) in which the flange portion 23*a*6 is spaced from the inside surface 18*g*2 of the second frame 18*g* on the drive transmitting member 30 side will be considered. At this time, the toner T deposited on the rotation shaft 23*a* and the toner T around the rotation shaft 23*a* receive a force by which these toners T are moved in the direction (upward direction in part (a) of FIG. 10) of being spaced from the drive transmitting member 30 side.

Thereafter, the toners T move in a direction (downward direction in part (a) of FIG. 10) toward the inside surface 18*g*2 of the second frame 18*g* on the drive transmitting member 30 side. At this time, the toner T described on the rotation shaft 23*a* and the toner T around the rotation shaft 23*a* will be considered. These toners T repeat swing such that the toners T reciprocate in the rotational axis direction of the rotation shaft 23*a* shown as the arrow H direction in part (a) of FIG. 10 in synchronism with the swing of the rotation shaft 23*a* in the rotational axis direction thereof shown as the arrow H direction in part (a) of FIG. 10. As a result, the toner T in the developer container 38 does not readily gather closely with respect to the direction toward the inside surface 18*a*2 on the drive transmitting member 30 side.

The behavior of the sealing sheet 24 at this time will be described using parts (a) to (c) of FIG. 10. As shown in part (a) of FIG. 10, the fixing portion 24*a* side of the sealing sheet 24 fixed to the rotation shaft 23*a* moves integrally with the rotation shaft 23*a*. The sealing portion 24*b* side of the sealing sheet 24 is in a state in which the sealing portion 24*b* is fixed at the peripheral edge portion of the opening 18*c*, and therefore, the sealing sheet 24 having flexibility follows the motion of the rotation shaft 23*a* while flexing.

At this time, as shown in parts (b) and (c) of FIG. 10, a part of the fixing portion 24*a* of the sealing sheet 24 causes flexure with respect to an arrow M direction and an arrow N direction in part (b) of FIG. 10. As a result, the toner T contacting the sealing sheet 24 is loosened, so that localized agglomeration is suppressed. Part (a) of FIG. 11 shows behavior of the toner T in the developer container 38 when the developer container 7 is transported with the drive transmitting member 30 facing upward. By transportation of the process cartridge 7, vibration is transmitted to the developer container 38 in the same direction as the rotational axis direction of the rotation shaft 23*a* shown as the arrow H direction in part (a) of FIG. 11. At this time, by acceleration of the vibration, a weight of the rotation shaft 23*a* and a weight of the toner T deposited on the rotation shaft 23*a* will be considered. By this, the gap L2 formed, with respect to the rotational axis direction of the rotation shaft 23*a*, between the inside surface 18*g*1 of the second frame 18*g* on the side opposite from the drive transmitting member 30 and the flange portion 23*a*8 of the rotation shaft 23*a* becomes small. At this time, the second elastic member 32 is compressed. On the other hand, the first elastic member 31 has a substantially natural length.

Thereafter, when the compressed state of the second elastic member 32 is restored to the original state, the elastic force of the second elastic member 32 acts on the rotation shaft 23*a*. As a result, the flange portion 23*a*8 of the rotation shaft 23*a* is moved in a direction (upward direction in part (a) of FIG. 11) in which the rotation shaft 23*a* is spaced from the inside surface 18*g*1 of the second frame 18*g* on the side opposite from the drive transmitting member 30, so that the gap L2 is extended in a direction in which the state of the first elastic member 32 is returned to the original state.

In a period in which the vibration during the transportation of the process cartridge 7 is continued, the rotation shaft 23*a* repeats movement in the direction in which the gap L2 becomes small and movement in the direction in which the state of the first elastic member 32 is returned to the original state. That is, the rotation shaft 23*a* repeats swing such that the rotation shaft 23*a* reciprocates in the rotational axis direction thereof shown as the arrow H direction in part (a) of FIG. 10. That is, when the rotation shaft 23*a* is moved in the rotational axis direction, the rotation shaft 23*a* is moved in the direction opposite to the previous movement direction thereof by the elastic force of the first elastic member 31 or by the elastic of the second elastic member 32. The flange portion 23*a*8 of the rotation shaft 23*a* is moved in the direction (upward direction in part (a) of FIG. 11) in which the flange portion 23*a*8 is spaced from the inside surface 18*g*1 of the second frame 18*g* on the drive transmitting member 30 side. At this time, the toner T deposited on the rotation shaft 23*a* and the toner T around the rotation shaft 23*a* receive a force by which these toners T are moved in the direction of approaching the drive transmitting member 30 side. Thereafter, the toners T move in a direction (downward direction in part (a) of FIG. 10) toward the inside surface 18*g*1 of the second frame 18*g* on the side opposite from the drive transmitting member 30. The toner T described on the rotation shaft 23*a* and the toner T around the rotation shaft 23*a* repeat swing in synchronism with the swing of the rotation shaft 23*a* in the rotational axis direction thereof shown as the arrow H direction in part (a) of FIG. 10. This swing is, such that the toners T reciprocate in the rotational axis direction of the rotation shaft 23*a* shown as the arrow H direction in part (a) of FIG. 11. As a result, the toner T in the developer container 38 does not readily gather closely with respect to the direction toward the inside surface 18*a*1 of the second frame 18*g* on the side opposite from the drive transmitting member 30.

The behavior of the sealing sheet 24 at this time will be described using parts (a) to (c) of FIG. 11. As shown in part (a) of FIG. 11, the fixing portion 24*a* side of the sealing sheet 24 fixed to the rotation shaft 23*a* moves integrally with the rotation shaft 23*a*. On the other hand, the sealing portion 24*b* side of the sealing sheet 24 is in a state in which the sealing portion 24*b* is fixed at the peripheral edge portion of the opening 18*c*, and therefore, the sealing sheet 24 having flexibility follows the motion of the rotation shaft 23*a* while flexing.

At this time, as shown in parts (b) and (c) of FIG. 11, a part of the fixing portion 24*a* of the sealing sheet 24 causes flexure with respect to an arrow M direction and an arrow N direction in part (b) of FIG. 11. As a result, the toner T contacting the sealing sheet 24 is loosened, so that localized agglomeration is suppressed.

The process cartridge 7 is transported in the vertically placed state in which the rotational axis direction of the rotation shaft 23*a* is the direction of gravitation. Even in such a case, the rotation shaft 23*a* repeats the swing such that the rotation shaft 23*a* reciprocates in the rotational axis direction thereof shown as the arrow H direction in part (a) of FIG. 10 and part (a) of FIG. 11. As a result, the toner T in the developer container 38 is prevented from agglomerating by localization.

Incidentally, in this embodiment, the first and second elastic members 31 and 32 comprising the coil spring are only engaged slidably around the outer peripheral surface of the rotation shaft 23*a*. The first and second elastic members 31 and 32 are not engaged with the rotation shaft 23*a*, the inside surface 18*g*2 of the second frame 18*g* on the drive transmitting member 30 side and the inside surface 18*g*1 of the second frame 18*g* on the side opposite from the drive transmitting member 30.

As another example, the first and second elastic members 31 and 32 may also be engaged with the rotation shaft 23*a*. As an engaging method in such an example, a boss is provided on the outer peripheral surface of the rotation shaft 23*a* and then the first elastic member 31 and/or second elastic member 32 comprising the coil spring may also be engaged with the boss through press-fitting. Further, the first elastic member 31 and/or second elastic member 32 comprising the coil spring can also be fixed to the outer peripheral surface of the rotation shaft 23*a* with an adhesive or the like.

Further, one end portion of the first elastic member 31 may also be engaged with the inside surface 18*g*2 of the second frame 18*g* on the drive transmitting member 30. Further, one end portion of the second elastic member 32 may also be engaged with the inside surface 18*g*1 of the second frame 18*g* on the side opposite from the drive transmitting member 30. As an engaging method in this case is as follows. A boss is provided on the inside surface 18*g*2 of the second frame 18*g* on the drive transmitting member 30 side. Further, a boss is provided on the inside surface 18*g*1 of the second frame 18*g* on the side opposite from the drive transmitting member 30. Then, the first and second elastic members 31 and 32 comprising the coil spring may also be engaged with the bosses, respectively, through press-fitting. Further, one end portions of the first and second elastic members 31 and 32 can also be fixed to the inside surface 18*g*2 of the second frame 18*g* on the drive transmitting member 30 side and the inside surface 18*g*1 of the second frame 18*g* on the side opposite from the drive transmitting member 30, respectively, with an adhesive or the like.

In either case, the motions of the rotation shaft 23*a*, the first elastic member 31 and the second elastic member 32 during the transportation of the process cartridge 7 are similar to those described above with reference to FIGS. 10 and 11. That is, the rotation shaft 23*a* repeats the swing such that the rotation shaft 23*a* reciprocates in the rotational axis direction of the rotation shaft 23*a* shown as the arrow H direction in part (a) of FIG. 10 and part (a) of FIG. 11. As a result, it is possible to suppress the agglomeration of the toner T in the localized state in the developer container 38. Other constitutions are similar to those in First Embodiment, and a similar effect can be obtained.

According to the present invention, by the elastic deformation of the sheet member with the movement of the recording material in the longitudinal direction of the developer accommodating chamber relative to the developer accommodating chamber, agglomeration of the developer during the transportation of the process cartridge can be effectively suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-066569 filed on Mar. 30, 2018, which is hereby incorporated by reference herein in its entirety.

What is claimed is:

1. A developer container comprising:

a developer accommodating portion configured to accommodate a developer;

a rotatable member rotatably supported inside said developer accommodating portion and including a rotation shaft provided along a longitudinal direction of said developer accommodating portion; and a flexible sheet member including a first end portion fixed to said rotatable member and a second end portion which is attached to a part of said developer accommodating portion in an unused state and which is peelable, for use, off the part, wherein said developer container further comprises an elastic member, which is provided between an end portion of said rotatable member and an inside surface of said developer accommodating portion with respect to the longitudinal direction, and which is elastically deformable in the longitudinal direction, wherein with respect to the longitudinal direction, between the end portion of said rotatable member and the inside surface of said developer accommodating portion, a gap is formed to permit movement of said rotatable member relative to said developer accommodating portion, and wherein in the unused state, said sheet member is elastically deformable together with said elastic member by the movement of said rotatable member relative to said developer accommodating portion in the longitudinal direction.

2. The developer container according to claim 1, wherein when said rotatable member is moved relative to said developer accommodating portion in the longitudinal direction, said elastic member is configured to cause said rotatable member to generate an urging force in an direction opposite to a movement direction of said rotatable member.

3. The developer container according to claim 1, wherein with respect to the longitudinal direction, said elastic member is disposed between the end portion of said rotatable member and the inside surface of said developer accommodating portion opposing the end portion of the rotatable member, on one side of said rotatable member.

4. The developer container according to claim 3, further comprising a drive transmitting member configured to transmit a driving force to said rotatable member, said drive transmitting member being rotatably provided on a side wall where the inside surface of said developer accommodating chamber is formed on the one side of said rotatable member, and wherein said elastic member includes one end portion fixed to said rotatable member and the other end portion fixed to said drive transmitting member with respect to the longitudinal direction.

5. The developer container according to claim 3, wherein said elastic member is also disposed between another end portion of said rotatable member and another inside surface of said developer accommodating portion, on the other side of said rotatable member opposing the one side of said rotatable member, with respect to the longitudinal direction.

6. The developer container according to claim 1, further comprising a covering member configured to cover an outer periphery of said elastic member.

7. The developer container according to claim 1, further comprising an opening through which an inside and an outside of said developer accommodating portion communicate with each other, wherein said second end portion of said sheet member includes a sealing portion configured to seal said opening by being peel-ably bonded to a peripheral edge portion of said opening.

8. The developer container according to claim 7, wherein said sealing portion is peeled off said opening by rotation of said rotatable member.

9. The developer container according to claim 8, wherein said sealing portion is bonded to the peripheral edge portion of said opening in a state in which said sheet member is folded back so that when said sealing portion is peeled off said opening by rotation of said rotatable member, said sealing portion is peeled off said opening along a direction oriented from a remote side of said rotatable member towards a close side of said rotatable member relative to said opening.

10. The developer container according to claim 1, wherein said sheet member has a thickness of 30 μm-60 μm.

11. A developing device comprising:

a developer container; and a developer carrying member provided on said developer container and configured to carry a developer, wherein said developing device is attachable to and detachable from a main assembly of an image forming apparatus, and wherein said developer container includes:

a developer accommodating portion configured to accommodate the developer;

a rotatable member rotatably supported inside said developer accommodating portion and including a rotation shaft provided along a longitudinal direction of said developer accommodating portion; and a flexible sheet member including a first end portion fixed to said rotatable member and a second end portion which is attached to a part of said developer accommodating portion in an unused state and which is peelable, for use, off the part, wherein said developer container further comprises an elastic member, which is provided between an end portion of said rotatable member and an inside surface of said developer accommodating portion with respect to the longitudinal direction, and which is elastically deformable in the longitudinal direction, wherein with respect to the longitudinal direction, between the end portion of said rotatable member and the inside surface of said developer accommodating portion, a gap is formed to permit movement of said rotatable member relative to said developer accommodating portion, and wherein in the unused state, said sheet member is elastically deformable together with said elastic member by the movement of said rotatable member relative to said developer accommodating portion in the longitudinal direction.

12. An image forming apparatus comprising:

a developer container;

a developer carrying member provided on said developer container and configured to carry a developer; and an image bearing member configured to bear a developer image, wherein said developer container includes:

a developer accommodating portion configured to accommodate the developer;

a rotatable member rotatably supported inside said developer accommodating portion and including a rotation shaft provided along a longitudinal direction of said developer accommodating portion; and a flexible sheet member including a first end portion fixed to said rotatable member and a second end portion which is attached to a part of said developer accommodating portion in an unused state and which is peelable, for use, off the part, wherein said developer container further comprises an elastic member, which is provided between an end portion of said rotatable member and an inside surface of said developer accommodating portion with respect to the longitudinal direction, and which is elastically deformable in the longitudinal direction, wherein with respect to the longitudinal direction, between the end portion of said rotatable member and the inside surface of said developer accommodating portion, a gap is formed to permit movement of said rotatable member relative to said developer accommodating portion, and wherein in the unused state, said sheet member is elastically deformable together with said elastic member by the movement of said rotatable member relative to said developer accommodating portion in the longitudinal direction.

* * * * *